US006997541B2

(12) United States Patent
Edamura et al.

(10) Patent No.: US 6,997,541 B2
(45) Date of Patent: Feb. 14, 2006

(54) PRINT POSITION ADJUSTING METHOD AND INK JET PRINTING APPARATUS AND INK JET PRINTING SYSTEM USING PRINT POSITION ADJUSTING METHOD

(75) Inventors: Tetsuya Edamura, Kanagawa (JP); Kiichiro Takahashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 10/649,956

(22) Filed: Aug. 28, 2003

(65) Prior Publication Data

US 2004/0046813 A1 Mar. 11, 2004

(30) Foreign Application Priority Data

Aug. 30, 2002 (JP) ..... 2002-255899
Aug. 22, 2003 (JP) ..... 2003-299319

(51) Int. Cl.
*B41J 2/145* (2006.01)

(52) U.S. Cl. ..... 347/41; 347/12

(58) Field of Classification Search ..... 347/41, 347/12, 15, 40, 43, 10, 16; 358/1.2, 1.9
See application file for complete search history.

(56) References Cited

U.S. PATENT DOCUMENTS

| | | | | |
|---|---|---|---|---|
| 6,120,129 | A | 9/2000 | Iwasaki et al. | |
| 6,334,659 | B1 | 1/2002 | Maeda et al. | |
| 6,371,592 | B1 | 4/2002 | Otsuka et al. | |
| 6,425,652 | B2 * | 7/2002 | Otsuki | 347/41 |
| 6,533,393 | B1 * | 3/2003 | Meyer et al. | 347/43 |

* cited by examiner

*Primary Examiner*—Lamson Nguyen
(74) *Attorney, Agent, or Firm*—Fitzpatrick, Cella, Harper & Scinto

(57) ABSTRACT

Multipass printing is carried out to print a plurality of registration patterns using different nozzle drive timings. A user selects the most appropriate one of the registration patterns. A driving pattern for the selected pattern is set as a reference value for the adjustment of a print position. This reference value is saved in a predetermined memory of a CPU. During a printing operation, in a unidirectional print mode, a printing operation is performed on the basis of the reference value. On the other hand, in a bidirectional and non-multipass print mode, a printing operation is performed on the basis of the reference value plus a predetermined correction value (+1). In a bidirectional and multipass print mode, a printing operation is performed on the basis of the reference value.

16 Claims, 24 Drawing Sheets

| | | PRINT MEDIA | | |
|---|---|---|---|---|
| | | ORDINARY PAPER | COATED PAPER | GLOSSY PAPER |
| PRINT GRADE | BEAUTIFUL | BIDIRECTIONAL PRINTING MULTIPASS PRINTING (FOUR PASSES) | UNIDIRECTIONAL PRINTING MULTIPASS PRINTING (FOUR PASSES) | UNIDIRECTIONAL PRINTING MULTIPASS PRINTING (EIGHT PASSES) |
| | STANDARD | BIDIRECTIONAL PRINTING NON-MULTIPASS PRINTING (ONE PASS) | BIDIRECTIONAL PRINTING MULTIPASS PRINTING (FOUR PASSES) | BIDIRECTIONAL PRINTING MULTIPASS PRINTING (EIGHT PASSES) |
| | FAST | BIDIRECTIONAL PRINTING NON-MULTIPASS PRINTING (ONE PASS) | BIDIRECTIONAL PRINTING NON-MULTIPASS PRINTING (ONE PASS) | BIDIRECTIONAL PRINTING MULTIPASS PRINTING (FOUR PASSES) |

FIG.7

FIRST PATTERN

REVERSE PATTERN

EJECTION ORDER OF NOZZLES WITHIN ONE BLOCK

PRINT POSITION ADJUSTING METHOD AND INK JET PRINTING APPARATUS AND INK JET PRINTING SYSTEM USING PRINT POSITION ADJUSTING METHOD

This application claims priority from Japanese Patent Application Nos. 2002-255899 and 2003-299319 filed Aug. 30, 2002 and Aug. 22, 2003, respectively, which are incorporated hereinto by reference.

BACKGROUND OF THE INVENTION

1. Field of the Invention

The present invention relates to a print position adjusting method of adjusting a drive timing for a print head, and more specifically, to a print position adjusting method of adjusting print positions for forward and backward scans as well as an ink jet printing apparatus and an ink jet printing system both using this method.

2. Description of the Related Art

Relatively inexpensive OA equipment such as personal computers and word processors has been popularized in recent years. Various output apparatuses such as printing apparatuses have been provided which output information created by such equipment. In particular, printing apparatuses are very popular, and methods of increasing the printing velocity of these apparatuses and techniques of improving image quality have been developed rapidly.

Further, among these printing apparatuses, especially, serial printers using an ink jet printing method receive much attention because they achieve high velocity printing or can print high quality images without requiring high costs.

For example, a bidirectional printing method is a technique of allowing a serial printer to achieve high velocity printing. For example, a multipass printing method is a technique of printing high quality images.

To increase printing velocity, it is contemplated that a printing operation may be performed using a print head having an increased number of print elements. However, this method results in an increase in the size of a print head. The bidirectional printing, in which a print head carries out printing during both forward and backward scans, is an effective method for increasing the printing velocity without increasing the size of the print head.

Although a simple proportional relationship is not established because printing apparatuses normally require time for sheet feeding and discharging and the like, the bidirectional printing substantially doubles the printing velocity compared to unidirectional printing that carries out printing only during a forward scan.

For example, it is assumed that a print head is used which has a printing density of 360 dpi and which has 64 ejection openings arranged in a direction different from a main scanning direction (for example, a sub-scanning direction, in which print media are fed) and that A4-sized print media are fed in their longitudinal direction for printing. In this case, the print head must execute about 60 printing scans in order to print images all over the print medium. In the unidirectional printing, all the printing scans are carried out during movement in only one direction from a predetermined scan start position. This printing method also involves non-printing scans in the opposite direction for returning from a scan end position to the scan start position. Consequently, about 60 reciprocatory scans are required in order to print images all over the print medium under the previously described conditions. On the other hand, in the bidirectional printing, a printing operation is performed during both forward and backward scans. Consequently, the entire image can be completed by executing about half or 30 reciprocatory scans. Thus, the bidirectional printing sharply reduces the time required for printing. This enables the printing velocity to be improved.

Now, description will be given of the multipass printing method as an example of a technique of improving image quality. If a printing operation is performed using a print head having a plurality of print elements, the grade of printed images depends markedly on the performance of the sole print head. For example, with an ink jet print head, the amount of ink ejected from ejection openings or the direction of the ejection may be affected by a small manufacturing error that may occur during a print head manufacturing process, such as differences among manufactured elements used to generate energy utilized to eject ink, such as electrothermal converters, i.e. ejection heaters. Consequently, the resulting image may have a nonuniform density and thus a reduced grade.

A specific example will be described below with reference to FIGS. 10A to 10C and FIGS. 11A to 11C. In FIG. 10A, reference numeral 901 denotes a print head that is assumed to be composed of eight nozzles 902 for simplification (in the specification, the term "nozzle" generally refers to an ejection opening, a liquid passage in communication with the ejection opening, and an element that generates energy utilized to eject ink, unless otherwise specified). Reference numeral 903 denotes ink ejected from the nozzle 902 as, for example, a droplet. Ideally, an almost equal amount of ink is ejected from each ejection opening in the same direction as shown in FIG. 10A. If such ejection is successfully achieved, ink dots of an equal size impact a print medium as shown in FIG. 10B to form a uniform image with a generally uniform density as shown in FIG. 10C.

However, in actuality, the individual nozzles in the print head 901 are different as described previously. Thus, if the print head 901 is used for printing as it is, the size or direction of an ejected ink droplet varies among the nozzles as shown in FIG. 11A. As a result, ink droplets impact a print medium as shown in FIG. 10B. This figure shows that in the head main scanning direction, blank portions having an area factor of less than 100% may appear periodically or conversely dots may overlap one another more than required or a blank line may appear as seen in the center of the figure. If dots impact the print medium in this condition, they have the density distribution shown in FIG. 11C in the direction in which the nozzles are arranged. As a result, human eyes perceive these phenomena as the nonuniformity of the density.

Thus, the multipass printing method has been devised in order to avoid the nonuniformity of the density. This method will be described below with reference to FIGS. 12 and 13.

The print head 901 is scanned three times as shown in FIG. 12A in order to print completely an area similar to that shown in FIGS. 10A to 10C and 11A to 11C. Two passes are used to complete an area composed of four pixels, the half of eight pixels, arranged in the vertical direction of the figure. In this case, the eight nozzles in the print head are grouped into two sets each including upper or lower four nozzles. Dots formed by one nozzle during one scan are determined by decimating image data to about half in accordance with a predetermined image data sequence. Then, during the second scan, dots are filled into the remaining half of the image data to complete the area composed of four pixels.

The multipass printing method reduces the adverse effect of differences among manufactured nozzles on printed images even with the print head 901, shown in FIG. 11A. A printed image is as shown in FIG. 12B, and such overlapping or blank lines as shown in FIG. 11B are not very marked. Consequently, as shown in FIG. 12C, the nonuniformity of the density is substantially suppressed compared to FIG. 11C.

When such multipass printing is carried out, image data is divided into two pieces for the first and second scans in accordance with a predetermined arrangement, i.e., a mask so that these pieces are complementary to each other. In the most common case, in this image data arrangement, i.e., a decimation pattern (thinning out pattern), each pixel for the first scan alternates with the corresponding pixel for the second scan in both vertical and horizontal directions. In a unit print area (in this case, composed of four pixels), the entire image is printed by the first scan for forming every other dot and the second scan for using a pattern opposite to that for the first scan to form dots. Further, the distance a print medium moves during each scan, i.e., the amount of sub-scan, is set at a specified value. In FIGS. 12 and 13, the print medium is moved a distance equal to four nozzles during each scan.

The multipass printing method is particularly effective in printing an image with a relatively high print duty such as a solid image in which the nonuniformity of the density or a blank line, if any, is visually perceived easily. However, in texts or ruled lines, which have a relatively low print duty, it is difficult to perceive the nonuniformity of the density or a stripe, if any. Accordingly, the multipass printing cannot be advantageously executed on these images. Thus, it is contemplated that in printing texts or ruled lines, the multipass printing is not carried out, while priority is given to a high printing velocity.

A registration technology of adjusting the impact positions of dots is another example of a technique of improving image quality in a dot matrix print method. The registration is a method of adjusting a position on a print medium at which a dot is formed, by for example, changing a drive timing for a print head.

Ink droplets ejected from the nozzles may impact at positions different from target ones owing not only to the varying ejection characteristics of the individual nozzles but also to the factor of the average head ejection characteristics or the mechanical factor of the main body. For example, the distance between each head nozzle and a print medium (paper distance) varies slightly among individual printing apparatuses because of manufacturing errors. A variation in paper distance results in a variation in the time required by ink droplets ejected from the nozzles to impact the print medium. This may vary the impact position during bidirectional printing. The same phenomenon may result from a variation in ejection velocity caused by differences among manufactured heads.

FIGS. 14A to 14E show an example of a variation in the impact position.

As shown in FIG. 14A, it is ideal for an ink droplet to impact a print medium at the same position during both forward and backward scans. However, if there is a large distance between each nozzle and the print medium, the impact position varies between a forward scan and a backward scan because the print medium is located below the intersection between the track of an ink droplet during the forward scan and the track of an ink droplet during the backward scan as shown in FIG. 14B. In contrast, if there is only a small distance between each nozzle and the print medium, the impact position varies between the forward scan and the backward scan because the print medium is located above the intersection between the track of the ink droplet during the forward scan and the track of the ink droplet during the backward scan as shown in FIG. 14C.

Further, if the ejection velocity is high, the ink droplets impact the print medium before their tracks meet as shown in FIG. 14D. On the other hand, if the ejection velocity is low, the ink droplets impact the print medium after their tracks have met as shown in FIG. 14E. In this manner, there are various factors relating to a variation in the impact position between the forward scan and the backward scan.

Further, if an image is formed using plural rows of nozzles, the impact position may vary owing to differences in average ejection characteristics (ejection direction and velocity) among the nozzle rows. Such a variation in the impact position may degrade images. Therefore, the registration is an essential technique for improving the image quality.

The registration is generally carried out as follows:

For example, in reciprocatory printing, to align the impact position during the forward scan with the impact position during the backward scan, ruled lines or the like are printed on a print medium while varying a relative print position condition between the forward scan and the backward scan, in order to adjust print timings for the forward and backward scans, respectively. An inspector visually checks the printed ruled lines to select conditions under which the impact position during the forward scan is aligned with the impact position during the backward scan, i.e. conditions under which ruled lines or the like are printed without being misaligned. The inspector then sets the impact position conditions in the printing apparatus by inputting them directly to the printing apparatus by key operations or the like or by operating a host computer using an application.

Further, if a printing operation is performed using a print head having plural rows of nozzles, the individual nozzle rows are used to print the respective ruled lines or the like on a print medium while varying relative print position conditions among the plurality of nozzles. Then, as described previously, the user selects optimum conditions under which the print position does not vary. Then, the inspector uses means similar to that described previously to set print position conditions in the printing apparatus so that different relative print position conditions are set for the respective nozzle rows.

In recent years, efforts have been made to increase the definition of ink dots, i.e. reduce the size of ink droplets in order to improve the image quality achieved by the ink jet printing apparatus. Accordingly, a small variation in the impact position or the like, which is unnoticeable in the case of conventional large dots, is now noticeable owing to the reduced size of dots. Therefore, in connection with an ink ejecting operation performed by the print head, not only the conventional registration but also the phenomena described below must be taken into account.

As a first phenomenon, main-droplet and satellite impact positions vary between the forward scan and the backward scan.

FIG. 15 is a schematic view showing the structure of a print head and ejected ink droplets.

For example, if the print head is adapted to eject ink on the basis of a BUBBLE JET ® method, thermal energy from a heater 1401 is used to generate bubbles in ink so that pressure generated by the bubbles causes the ejection of a predetermined amount of ink droplet present close to an ejection opening 1402. However, liquid-liquid separation, i.e., the separation of the ink droplet from the nozzle, is unstable. Accordingly, after a main droplet 1403, an ink droplet called a "satellite" 1404 is ejected. The satellite 1404 is formed by separating the trailing end of the ejected droplet from its remaining part. The satellite 1404 has a smaller volume and a lower ejection velocity than the main droplet 1403. Further, the satellite 1404 is generated whether the BUBBLE JET ® method or a piezoelectric method or the like is used as an ink ejecting method.

As shown in FIG. 16, the main droplet and the satellite fly in the same direction. However, since the print head carries out printing while moving in the main scanning direction, the main droplet and the satellite impact at different positions owing to a difference in ejection velocity between them. Using a main-droplet ejection velocity V, a satellite ejection velocity v, paper distance D, and a print head scanning velocity Vp, the distance L between the impact positions of the main droplet and satellite can be expressed as follows:

$$L=Vp\times(D/v)-Vp\times(D/V)$$

In this manner, dots 1501 and 1502 are formed on the print medium by the main droplet and the satellite, respectively. However, if the main droplet dot and the satellite dot are sufficiently small, it is possible to consider only the main droplet to contribute to printing while neglecting the adverse effect of the satellite.

However, as described above, as the size of ink droplets and thus the size of the main droplet decrease, it becomes impossible to neglect the adverse effect of the satellite. That is, the volume of the satellite relates closely to ejection characteristics determined by the shape of the nozzles or the like. Thus, it does not decrease consistently with the size of the main droplet. Accordingly, as the size of the main droplet dot decreases, the difference in size between the satellite dot and the main droplet dot tends to decrease. Specifically, the leading end of the ejected droplet becomes the main droplet, whereas the separated trailing end becomes the satellite dot. Thus, the characteristics of the ejection port or ink, specifically viscosity and surface tension, affect the size of the satellite dot. Accordingly, even if the size of the main dot is reduced, the size of the satellite dot does not decrease in proportion to the reduction in the size of the main droplet. As a result, a decrease in the size of droplets relatively enhances the adverse effect of the satellite dot. Therefore, it is important that an image forming technique takes even the satellite into consideration.

An example is given in which ruled lines are printed in the vertical direction (sub-scanning direction). Description will be given using a head having 304 nozzles arranged at a pitch of 600 dpi.

If bidirectional printing is carried out, the positional relationship between main droplet dots and satellite dots is reversed between a forward scan and a backward scan.

FIG. 17A is a schematic view showing the positions of main droplet dots and satellite dots observed if bidirectional printing is carried out in non-multipass printing. FIG. 17B is an enlarged schematic view of a part of the main droplet and satellite dots corresponding to one scan.

If one-pass printing, i.e., non-multipass printing, is carried out, a forward scan and a backward scan are switched at intervals of 304-nozzle widths (about 13 mm). Accordingly, the results of printing are such that the positions of the satellite dots are reversed at intervals of about a 13-mm width.

FIG. 17C shows the line density of printed ruled lines. For example, when the main droplet ejection velocity V=15 m/s, the satellite ejection speed=10 m/s, the paper distance D=1.6 mm, and the scanning velocity Vp=25 inch/s, the length of misalignment L is 0.03 mm. Since human sense of sight is characterized by having a low resolution, the ruled lines are substantially perceived as the line density schematically represented in FIG. 17D. Between a forward scan and a backward scan, the line density is reversed as shown in FIG. 17E. The line density during the forward scan does not substantially overlap the line density during the backward scan. Accordingly, the results of printing are such that parts of a ruled line each corresponding to the nozzle width are connected together irregularly. To join together smoothly parts of the ruled line printed during forward and backward scans, respectively, the print head must be registered as shown in FIG. 18A to maximize the overlapping of the line densities of forward and backward scan dots.

On the other hand, if multipass printing is carried out, forward printing and backward printing are equally executed around pixels. Consequently, satellite dots are almost equally formed at the right and left sides of main droplet dots (see FIG. 19A). Then, since human sense of sight is characterized by having a low resolution, the line density shown in FIG. 19B is substantially perceived. Thus, to print ruled lines smoothly, the print head must be registered so that the main droplet dots constitute the same column.

As described above, if the adverse effect of satellite dots is not negligible, the optimum registration value varies between multipass printing and non-multipass printing. Furthermore, the length of misalignment L increases in proportion to the moving velocity of the print head. Consequently, if the print head is moved fast in order to increase the velocity of the printing apparatus, the distance L between a main droplet dot and a corresponding satellite dot increases. This makes the satellite dot noticeable, and the problem becomes more serious.

Next, a second phenomenon will be described. It is assumed that a plurality of driving motors are used which use different time intervals at which ink is ejected (for example, a 1,200-dpi mode and a 600-dpi mode) and that registration is carried out on the basis of an ink ejection timing in one of the driving modes. Then, if a printing operation is performed in the other driving mode, the impact positions of dots during a forward scan may be slightly misaligned with respect to the impact positions of dots during a backward scan. This misalignment is noticeable owing to the reduced diameter of the dots.

A block division driving method has hitherto been known which is used in driving a print head with a plurality of nozzles to eject ink, in order to reduce the power supply capacity required for driving: the method comprises dividing a group of nozzles into a plurality of blocks and driving these blocks simultaneously so as to eject ink.

FIGS. 20 to 22 show ejection timings for the respective nozzles used if the block division driving method is used to eject ink from the nozzles in accordance with print data. As shown in FIG. 20, for example, 304 nozzles in a head are divided into a plurality of blocks (in this case, 19 blocks). Then, the ejection order of the nozzles in each block is specified as shown in FIG. 21. Then, ejection is carried out in accordance with the pulse timings shown in FIG. 22. That is, at one point in time, ink is ejected from the nozzle corresponding to the ejection order 1 in all the blocks. Then, a time d later, ink is ejected from the nozzle corresponding to the ejection order 2 in all the blocks. Similarly, ejection is sequentially executed on the nozzles corresponding to the ejection orders 3 to 16 using sequentially delayed timings.

The control based on the block division driving enables the number of simultaneous ejections to be reduced. This makes it possible to prevent an excessive current from being instantaneously generated compared to the simultaneous driving of all the nozzles.

However, with the above method, the respective nozzles within each block use different ejection timings. Accordingly, the impact position varies slightly depending on the nozzle. Specifically, if a CR velocity is 151 inch/sec and the delay time d is 3.5 μsec and if an attempt is made to print a ruled line parallel with the nozzle rows, then a ruled line actually obtained is shifted from the parallel position by 1/1,200 inch (about 21 μm) as shown in FIG. 23. This phenomenon may degrade images. Thus, in order to reduce the shifting width w shown in FIG. 23, it is desirable to minimize the delay time d for the drive timing.

Ink jet printers normally employ a method of ejecting ink from the nozzles by exerting pressure on the ink on the basis of bubbling caused by film boiling on heaters or the vibration of piezoelectric elements. The pressure propagates not only to the front of each nozzle (in ejecting direction) but also to its rear, i.e. to the inside of a liquid chamber. The pressure propagated to the liquid chamber further propagates to surrounding nozzles. As a result, the ink in nozzles present close to the nozzle from which ink has been ejected is vibrated. When pressure is exerted while the ink is being vibrated, ink may not be correctly ejected owing to the unstable state in the nozzles. Thus, after ejection, the next ejection must be started after a pause corresponding to the time required to stop the vibration. With a small number of simultaneous ejections, only a low pressure propagates to surrounding nozzles. Accordingly, the vibration of the ink in a nozzle is stopped in a relatively short time.

In multipass printing, the number of ejections per scan normally decreases with an increase in the number of passes (the number of scans required to complete an image occupying a predetermined area). Specifically, in printing with a large number of passes, the number of simultaneous ejections is relatively small. Consequently, the adverse effect of the pressure propagation is not substantially produced, thus allowing the delay time d for the drive timing to be reduced. In contrast, in printing with a small number of passes, the number of ejections is relatively large. Consequently, the above adverse effect is produced, thus requiring the delay time d for the drive timing to be extended. Thus, some printers having a plurality of print modes with different number of passes carry out printing using a plurality of drive modes with different delay times d for the drive timing.

However, the dot shifting width w varies depending on the drive mode. Thus, if reciprocatory printing is carried out using the same reciprocatory registration value in spite of different drive modes, the impact position may vary between a forward scan and a backward scan. This will be described below with reference to the drawings.

FIGS. 24A and 24B are schematic views showing an arrangement of dots on a sheet in order to describe a phenomenon in which when a checker-pattern-like mask is used for two-pass printing, the impact position varies during bidirectional printing because of different drive modes. FIG. 24A shows a drive mode in which the delay time d for the drive timing is set at 3.5 μsec in order to reduce the dot shifting width w to 1,200 dpi (1/1,200 inch) (this mode is called a "1,200-dpi drive mode"). This figure shows, in its left, the positions of dots obtained during the first and second scan ejections, and in its right, the arrangement of the dots on a sheet after printing. The scanning direction is reversed between the first scan and the second scan. Accordingly, before the second scan, i.e., before backward printing, the ejection order within each block is reversed.

FIG. 24B shows a drive mode in which the delay time d for the drive timing is set at 7.0 μsec in order to reduce the dot shifting width w to 600 dpi (1/600 inch) (this mode is called a "600-dpi drive mode") This figure shows, in its left, the positions of dots obtained during the first and second scan ejections, and in its right, the arrangement of the dots on a sheet after printing.

For both printing operations, the reciprocatory registration value is adjusted so that the optimum impact position is obtained in the 1,200-dpi drive mode.

In each drive mode, the ejection order within each block is reversed between a forward print scan and a backward print scan in order to deal with reciprocatory printing.

As seen in FIG. 24B, when 600-dpi driving printing is executed with the reciprocatory registration value set so as to obtain the optimum impact during 1,200-dpi driving, the impact position is misaligned with respect to the optimum one because the dot shifting width in this drive mode is different from that in the 1,200-dpi drive mode.

If dots of a large diameter are formed on a medium when ink impacts it, the adverse effect of the impact misalignment is relatively insignificant. Accordingly, the degradation of images is of the level at which it is not perceived. However, as the size of ink droplets decreases to reduce the dot diameter the adverse effect of the impact misalignment becomes so significant as not to be negligible.

As described above, as the size of ejected ink droplets decreases to reduce the diameter of printed dots, the adverse effect of a variation in the impact position between a forward scan and a backward scan becomes significant depending on the drive mode of the block division driving. Thus, disadvantageously, the degradation of images is noticeable.

SUMMARY OF THE INVENTION

The present invention is provided in order to solve the above problems. It is an object of the present invention to provide a print position adjusting method used in an ink jet printing apparatus having a plurality of print modes with different arrangements of dots printed during one scan, to prevent the degradation of printed images in all the print modes, as well as an ink jet printing apparatus and an ink jet printing system both using this method. Specifically, the plurality of print modes may include a unidirectional print mode, a bidirectional print mode, a multipass print mode, and a non-multipass print mode.

It is another object of the present invention to provide an ink jet printing apparatus and an ink jet printing method that can print high-grade images by preventing images from being degraded in spite of different modes used to drive a print head.

The present invention provides a print position adjusting method of using a print head having a plurality of arranged nozzles from which ink is ejected to a print medium, to perform alternately a printing operation of scanning the print head in a predetermined direction different from a direction in which the plurality of nozzles are arranged, to eject ink from the nozzles to a print medium during the scan, and a paper feeding operation of relatively moving the print medium and the print head a distance corresponding to a predetermined movement pitch in a direction different from the scanning direction of the print head, the print head being scanned over the print medium by reciprocating in the predetermined direction, to enable bidirectional printing in which the printing operation is performed during both a forward scan and a backward scan, the method being characterized by comprising a plurality modes having different dot arrangements for a scan of the print head, a mode selecting step of selecting one of the plurality of print modes, a determining step of determining an adjustment value that varies a drive timing for the plurality of nozzles between the forward scan and the backward scan in accordance with the print mode selected in the mode selecting step, and a printing step of performing the printing operation and the paper feeding operation using the drive timing for the nozzles determined on the basis of the adjustment value determined in the determining step.

The present invention provides an ink jet printing apparatus that uses a print head having a plurality of arranged nozzles from which ink is ejected to a print medium, to perform alternately a printing operation of scanning the print head in a predetermined direction different from a direction in which the plurality of nozzles are arranged, to eject ink from the nozzles to a print medium during the scan, and a paper feeding operation of relatively moving the print medium and the print head a distance corresponding to a predetermined movement pitch in a direction different from the scanning direction of the print head, the print head being scanned over the print medium by reciprocating in the predetermined direction, to enable bidirectional printing in which the printing operation is performed during both a forward scan and a backward scan, the apparatus being characterized by comprising a plurality modes having different dot arrangements for a scan of the print head, mode selecting means for selecting one of the plurality of print modes, determining means for determining an adjustment value that varies a drive timing for the plurality of nozzles between the forward scan and the backward scan in accordance with the print mode selected by the mode selecting means, and printing means for performing the printing operation and the paper feeding operation using the drive timing for the nozzles determined on the basis of the adjustment value determined by the determining means.

The present invention provides an ink jet printing system composed of an ink jet printing apparatus and a host computer connected to the ink jet printing apparatus, the ink jet printing apparatus using a print head having a plurality of arranged nozzles from which ink is ejected to a print medium, to perform alternately a printing operation of scanning the print head in a predetermined direction different from a direction in which the plurality of nozzles are arranged, to eject Ink from the nozzles to a print medium during the scan, and a paper feeding operation of relatively moving the print medium and the print head a distance corresponding to a predetermined movement pitch in a direction different from the scanning direction of the print head, the print head being scanned over the print medium by reciprocating in the predetermined direction, to enable bidirectional printing in which the printing operation is performed during both a forward scan and a backward scan, the system being characterized by comprising a plurality modes having different dot arrangements for a scan of the print head, mode selecting means for selecting one of the plurality of print modes, determining means for determining an adjustment value that varies a drive timing for the plurality of nozzles between the forward scan and the backward scan in accordance with the print mode selected by the mode selecting means, and printing means for performing the printing operation and the paper feeding operation using the drive timing for the nozzles determined on the basis of the adjustment value determined by the determining means.

With the above arrangements, the determining step uses different adjustment values for a case in which the movement pitch during the paper feeding operation is smaller than the arrangement pitch of the nozzles in the print head and for other cases. Consequently, in the bidirectional printing, an image is printed at an appropriate position whether or not the movement pitch during the paper feeding operation is smaller than the arrangement pitch of the nozzles in the print head.

Furthermore, even with a plurality of drive modes for the print head, the impact positions of dots during a forward scan can always be aligned with the impact positions of dots during a backward scan in accordance with a selected drive mode.

The above and other objects, effects, features and advantages of the present invention will become more apparent from the following description of embodiments thereof taken in conjunction with the accompanying drawings.

BRIEF DESCRIPTION OF THE DRAWINGS

FIG. 7 is a table showing printing methods determined on the basis of a combination of a print mode and a print medium;

DETAILED DESCRIPTION OF PREFERRED EMBODIMENTS

An embodiment of the present invention will be described with reference to the drawings.

(Whole Configuration)

Figure 1:
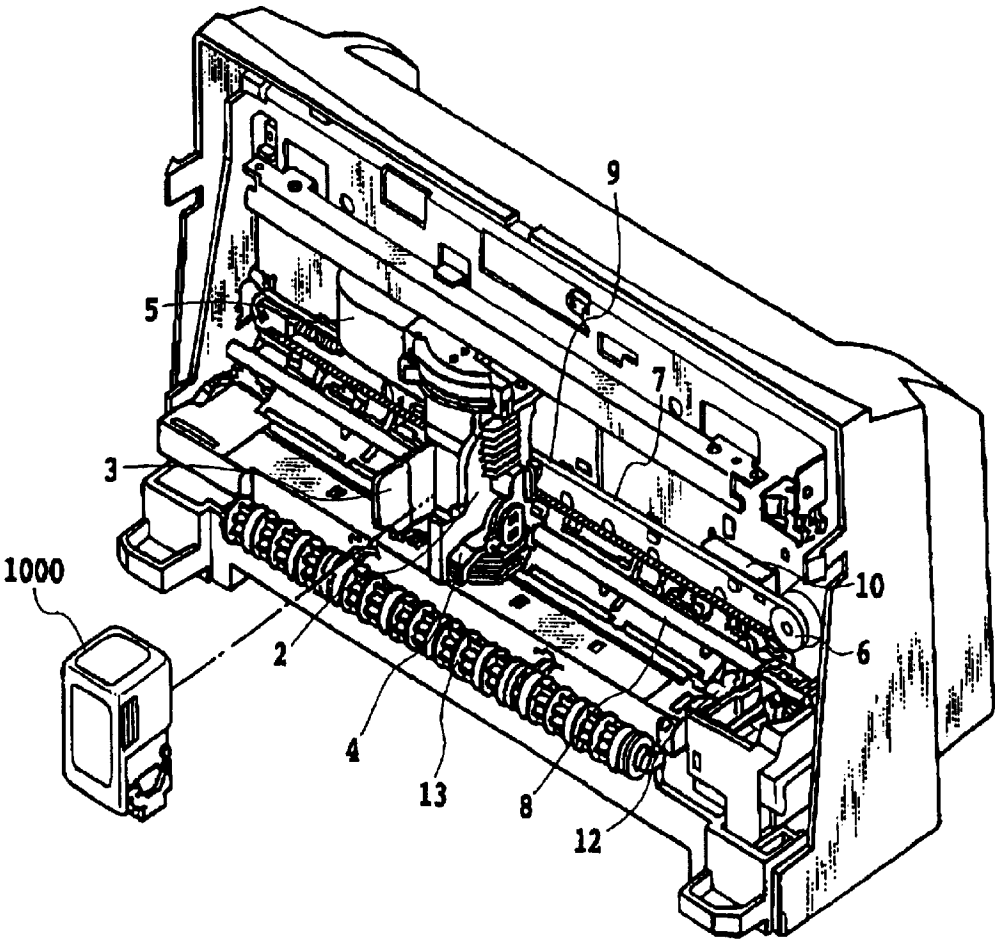
FIG. 1 is a perspective view showing that a front cover has been removed from an inkjet printing apparatus to which the present invention is applicable.

FIG. 1 is a schematic perspective view of an ink jet printer to which the present invention is applicable. This figure shows that a front cover of the ink jet printer has been removed to expose the interior of the apparatus.

Reference numeral 100 denotes a replaceable head cartridge. Reference numeral 2 denotes a carriage unit that removably holds the Ink jet cartridge. Reference numeral 3 denotes a holder used to fix the ink jet cartridge 100 to the carriage unit 2. The ink jet cartridge 1000 is installed in the carriage unit 2, and then a cartridge fixing lever 4 is operated. Then, in union with this, the ink jet cartridge 100 is brought into pressure contact with the carriage unit 2. Further, at the same time when the pressure contact positions the ink jet cartridge 1000, an electric contact provided in the carriage unit 2 to transmit required signals comes into contact with an electric contact in the ink cartridge 1000. Reference numeral 5 denotes a flexible cable used to transmit electric signals to the carriage unit 2.

Reference numeral 6 denotes a carriage motor constituting a drive source for reciprocating the carriage unit 2 in the main scanning direction. Reference numeral 7 denotes a carriage belt that transmits the driving force of the carriage motor 6 to the carriage unit 2. Reference numeral 8 denotes a guide shaft that extends in the main scanning direction to support the carriage unit 2 while guiding it while it is moving. Reference numeral 9 denotes a transmission photo coupler attached to the carriage unit 2. Reference numeral 10 denotes a baffle provided close to a carriage home position. When the carriage unit 2 reaches its home position, the baffle 10 blocks the optical axis of the photo coupler 9 to allow the carriage home position to be detected. Reference numeral 12 denotes a home position unit including a capping member that caps the front surface of the ink jet head, sucking means for sucking the interior of the cap, and a recovery system such as a member that wipes the front surface of the head. Reference numeral 13 denotes a discharge roller used to discharge print media. The discharge roller 13 cooperates with a spur-like roller (not shown) in sandwiching a print medium between them to discharge it out of the apparatus. Reference numeral 14 denotes a line feed unit that conveys a print medium in the sub-scanning direction by a predetermined amount.

(Head Configuration)

Figure 2:
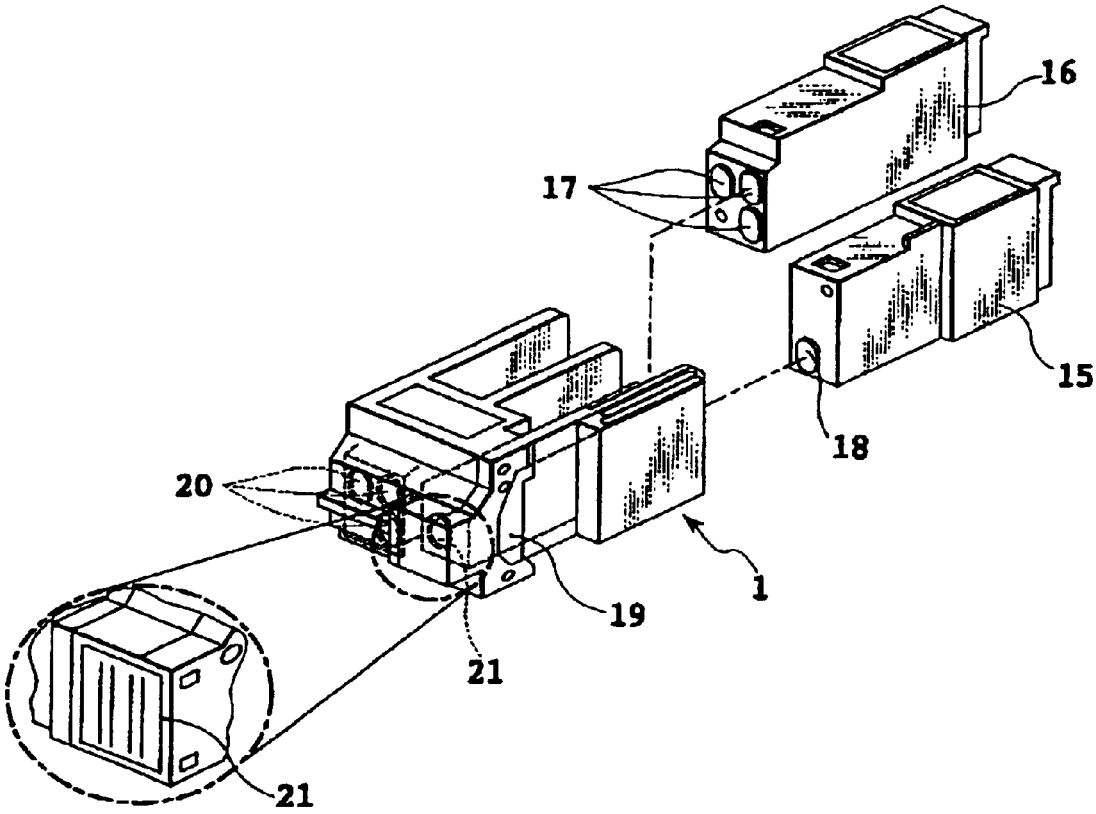
FIG. 2 is a perspective view showing the details of a head cartridge.

FIG. 2 is a perspective view showing the details of the head cartridge 1000, used in the present embodiment.

Reference numeral 15 denotes a replaceable ink tank in which Bk (black) ink is stored. Reference numeral 16 denotes a replaceable ink tank in which ink made of a C (cyan), M (magenta), or Y (yellow) coloring agent is stored. Reference numeral 17 denotes an ink supply opening in the ink tank 16 which is connected to the ink cartridge 1000 to supply the ink. Reference numeral 18 also denotes an ink supply opening in the ink tank 15. The ink supply openings 17 and 18 are configured to be connected to a supply tube 20 to supply the ink to a print head 21. Reference numeral 19 denotes an electric contact configured to be connected to transmit signals based on print data to the print head 21.

Further, four lines shown in the front surface of the print head 21 show nozzle rows of ink ejecting nozzles from which the ink is ejected. The Bk (black) ink, C (cyan) ink, M (magenta) ink, and Y (yellow) ink are ejected from the respective nozzle rows.

In the present embodiment, the four color inks are ejected. However, the present invention is not limited to this aspect. Other color inks such as light cyan and light magenta may be ejected.

Figure 3:
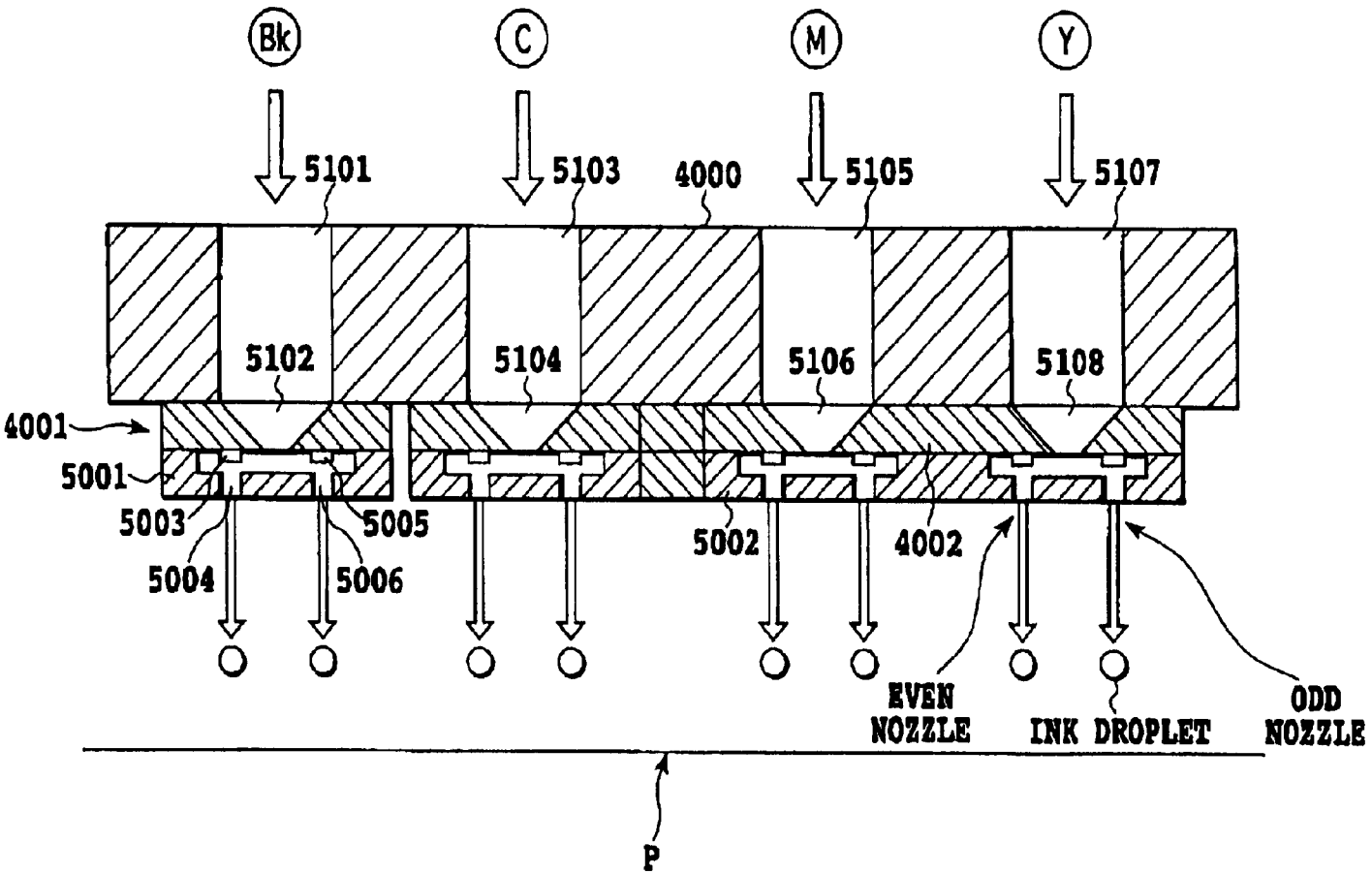
FIG. 3 is a schematic sectional view schematically showing a configuration of a print head.

FIG. 3 is a schematic side sectional view schematically showing the print head 21.

Reference numerals 5102, 5104, 5106, and 5108 denote common liquid chambers that receive the ink to be ejected. The common liquid chambers are formed by anisotropic etching in surfaces of heater boards 4001 and 4002 which are opposite to their surfaces formed by a semiconductor process. The common liquid chambers 5102, 5104, 5106, and 5108 are in communication with the respective groups of liquid channels corresponding to the respective groups of ejection heaters. The common liquid chambers 5102, 5104, 5106, and 5108 are separated or partitioned so as to prevent the different color inks from being mixed with one another. The common liquid chambers 5102, 5104, 5106, and 5108 correspond to the black ink, cyan ink, magenta ink, and yellow ink, respectively. Reference numerals 5003 and 5005 denote the components of the ejection heater which correspond to the ejection openings 5004 and 5006, respectively, and to liquid channels, respectively, which are in communication with these ejection openings That is, these components are ejection heater portions arranged at the respective sides of the common liquid chamber 5102. In this manner, the nozzle from which each ink is ejected is composed of two nozzle rows. In the present embodiment, the nozzle row 5004 in the left of FIG. 3 is referred to as an "even nozzle". The nozzle row 5006 in the right of FIG. 3 is referred to as an "odd nozzle" The other groups of ejection heaters have similar configurations. Thus, their description is omitted.

Reference numerals 5101, 5103, 5105, and 5107 denote common liquid chambers formed in a base plate 4000 in communication with the common liquid chambers 5102, 5104, 5106, and 5108. Reference numerals 5001 and 5002 denote orifice plates in which the ink channels and the nozzles are formed. The orifice plates are normally formed of a heat resistant resin. Further, reference character P denotes a print medium.

Description will be given of ink ejection by taking the black ink by way of example. The ink has been filled up to the vicinity of the ejection opening 5004. To eject the ink, an electric signal is transmitted to the ejection heater 5003. The ejection heater 5003 generates heat for a predetermined time to generate instantaneously bubbles in ink present close to the heater. Then, pressure generated by the bubbles causes a predetermined amount of ink to be ejected from the ejection opening 5004 as a droplet. In the present embodiment, such a BUBBLE JET ® method is used to eject the ink. However, the present invention is not limited to this aspect. A piezoelectric method may also be used.

(Electrical Configuration)

Figure 4:
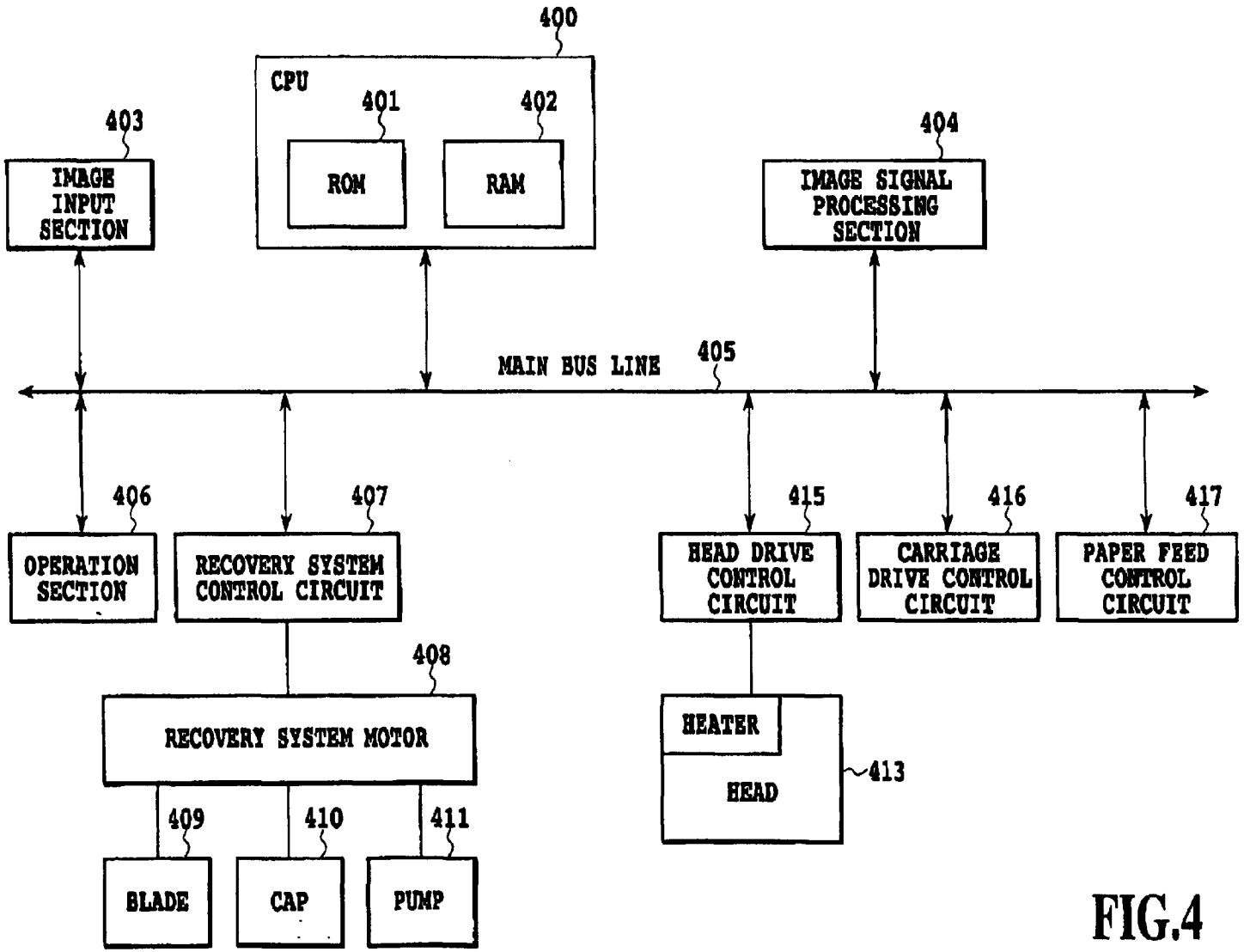
FIG. 4 is a block diagram showing an electric configuration of the ink jet printing apparatus.

FIG. 4 is a block diagram showing an electric configuration of the ink jet printing apparatus The ink jet printing apparatus according to the present embodiment is connected to the host computer to perform a printing operation in accordance with image data inputted by the host computer. Reference numeral 400 denotes a CPU that controls the whole ink jet printing apparatus. The CPU 400 comprises a ROM 401 and a random memory (RAM) 402 as memories. The CPU 400 transmits a drive instruction to each driving section via a main bus line 405. Furthermore, an image input section 403 is connected to the main bus line 405 so that image data from the host computer can be inputted to the image Input section 403. An image signal processing section 404 converts the thus inputted image data into ejection signals corresponding to the respective nozzles in the print head. Furthermore, operations of operation buttons provided on the printing apparatus are transmitted to the CPU 400 via an operation section 406

In accordance with operation signals inputted to the operation section 406 or various instructions transmitted by the host computer, the CPU 400 transmits drive instructions to control circuits for the respective driving sections. The control circuits are as described below. A recovery system control circuit 407 controls a driving of a recovery system motor 408 acting as a power source for members such as a blade 409, a cap 410, and a suction pump 411 which execute a recovery process. A head drive control circuit 415 controls a driving of the heaters in the print head 413. A carriage drive control circuit 416 controls the scan of the carriage in the main scanning direction. A paper feed control circuit 417 drivingly controls driving members such as a conveying roller which relate to paper feeding.

In the present embodiment, the host computer inputs image data to the ink jet printing apparatus. However, the ink jet printing apparatus itself may create image data. Further, in the present embodiment, the image signal processing section 404 converts the image data into ejection signals for the respective nozzles. However, the present invention is not limited to this aspect. The host computer itself may process and convert the image data into ejection signals for the respective nozzles and then input the resulting ejection signals to the ink jet printing apparatus.

(Registration)

Now, description will be given of registration carried out in the ink jet printing apparatus configured as described above. In the present embodiment, a registration reference value is first determined. Then, every time the mode is switched, the reference value is fine-tuned in accordance with the new print mode so that a printing operation can always be performed with the optimum registration value. First, description will be given of how to determine a registration reference value.

Figure 5:
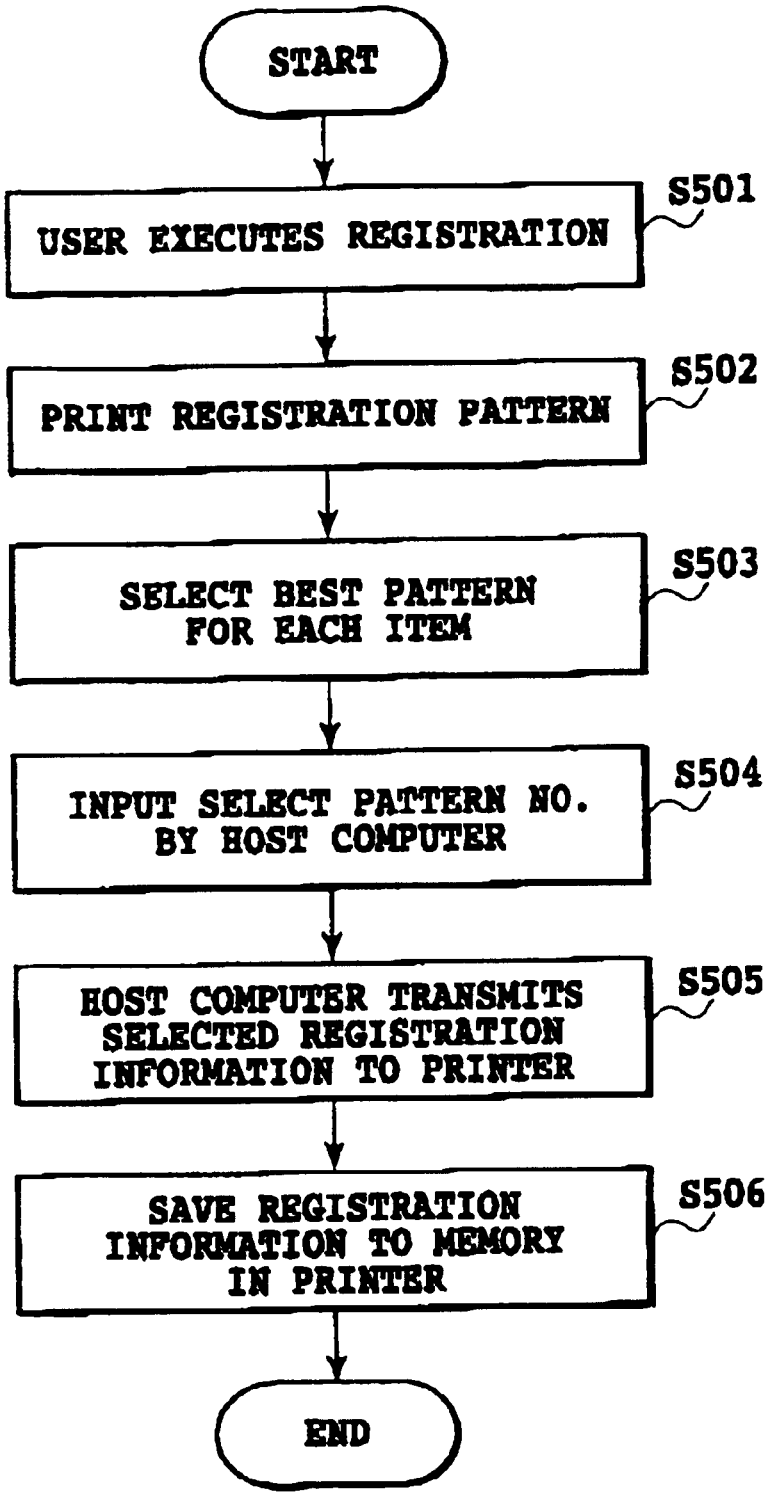
FIG. 5 is a flowchart showing registration adjustment.

FIG. 5 is a flow chart showing registration.

A user selects registration by operating the host computer (step 501). The host computer transmits a registration pattern print instruction to the printing apparatus. Upon receiving the print instruction, the printing apparatus performs required recovery operations such as suction wiping, and preliminary ejection and then prints a registration pattern (step 502).

Figure 6:
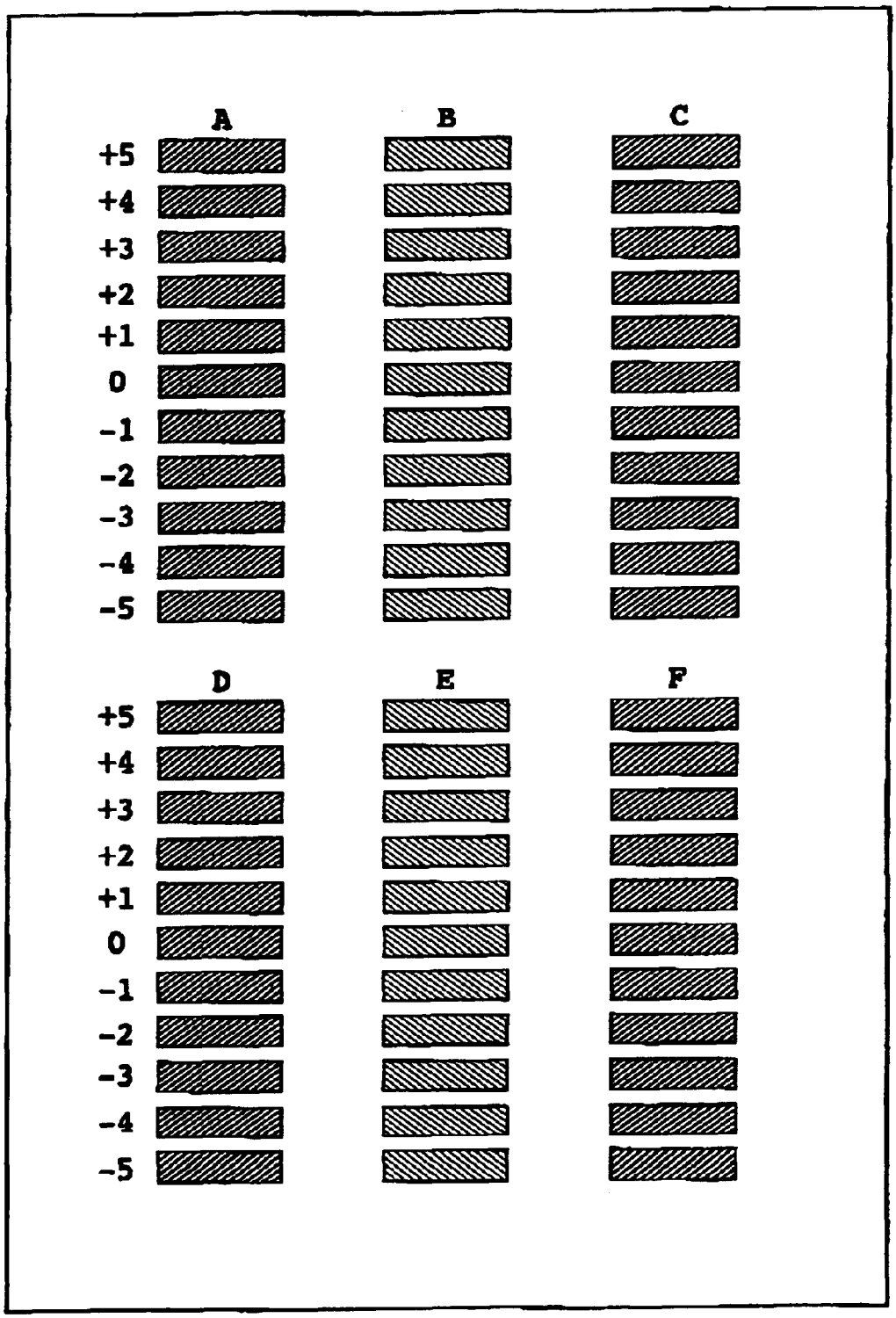
FIG. 6 is a diagram showing print patterns for registration adjustment.

FIG. 6 is a view showing a registration pattern.

With this pattern, six adjustment items are printed. Specifically, adjustment items A to F are used for black even and odd registration, cyan even and odd registration, magenta even and odd registration, black bidirectional registration, cyan bidirectional registration, and black and color row registration, respectively. Each registration item is composed of 11 adjustment patches with different ejection timings.

The even and odd registration items A to C are used to correct a variation in the impact position caused by a difference in ejecting direction/velocity between the even nozzle and the odd nozzle. These items are printed only during a forward scan using the non-multipass printing method. The 11 patches involve different ejection timings each used for ejection from the even nozzle and then from the odd nozzle. If exactly the same ejecting direction/velocity is used for both even and odd nozzles, an ejecting timing with which dots from the respective nozzles impact the same column is set to correspond to a "0" patch. Furthermore, using the "0" patch as a reference, plural patches are printed above and below this patch so that dots from the odd nozzle impact at 1,200 dpi at positions ±1 to 5 pixels away from the preceding patch. Here, the direction in which the ejection timing for the odd nozzle is delayed is defined to be plus (above). The direction in which the ejection timing for the odd nozzle is advanced is defined to be minus (below). That is, changing the ejecting timing in the plus direction shifts the position at which an odd nozzle dot Is formed, in the print head scanning direction relative to an even nozzle dot.

The bidirectional registration items D and E are used to correct a variation in the impact position between a forward scan and a backward scan. These items are printed using only the even nozzle. The resulting patches constitute a uniform pattern with a duty of 25% and are bidirectionally printed using only the even nozzle and the multipass printing method. Different backward scan ejection timings are used for the respective 11 patches. If the ejecting speed=15 m/s and the paper distance=1.6 mm, an ejecting timing with which a forward scan print dot and print dots during a backward scan impact the same column is set to correspond to a "0" patch. Furthermore, using the "0" patch as a reference, patches are printed above and below this patch so that print dots during a backward scan impact at 1,200 dpi at positions ±1 to 5 pixels away from the preceding patch. Here, the direction in which the ejection timing for the backward scan is delayed is defined to be plus. The direction in which the ejection timing for the backward scan is advanced is defined to be minus.

The black and color range registration F is used to correct a variation in the impact position between the BK nozzle and the color nozzle. This item is unidirectionally printed using only the even nozzles and the multipass printing method. The patches of this item constitute a uniform pattern such that black, cyan, magenta, and yellow have the same duty and that the total duty is 25%. The 11 patches involve different ejection timings each used for ejection from the black nozzle and then from the color nozzles. If exactly the same ejecting direction/velocity is used for both black and color nozzles, a timing with which dots from the respective nozzles impact the same column is set to correspond to a "0" patch. Furthermore, using the "0" patch as a reference, patches are printed above and below this patch so that dots from the color nozzles impact at 1,200 dpi at positions ±1 to 5 pixels away from the preceding patch.

The user visually checks the printed registration pattern and selects, for each adjustment item, one of the patches which is most uniform and which has the least noise (step 503). The user then inputs the pattern number of the selected patch from the host computer (step 504). The inputted values are transmitted from the host computer to the printing apparatus main body as a registration reference value (step 505). The values are then stored in a nonvolatile memory in a storage device (step 506). In this case, the same value is stored for the yellow even and odd registration and for the magenta even and odd registration. Further, the same value is stored for the magenta and yellow bidirectional registrations and for the cyan bidirectional registration.

In an actual printing operation, the thus determined registration reference values are fine-tuned as described below in accordance with a selected print mode.

EXAMPLE 1

Ink jet printing apparatuses have a plurality of print modes in order to meet users' demands. Since the printing operation varies with the print mode, the registration reference value must further be fine-tuned depending on the selected print mode. In this example, description will be given of a printing operation of switching the printing method among unidirectional printing, bidirectional printing, and multipass printing depending on the print mode. Specifically, description will be given of a registration value fine-tuning method for preventing the nonuniformity of the density caused by the misaligned impact positions of satellite dots associated with the characteristics of a particular printing method.

(Printing Operation)

The ink jet printing apparatus according to the present embodiment is provided with three print modes in order to achieve the respective grades of print images as desired by users. The user can select a "beautiful" mode if he or she desires a high-quality image in spite of a long time required for printing The user can select a "fast" mode if he or she desires a reduction in the time required for printing in spite of the slight degradation of images. The user can select a "standard" mode if he or she desires a standard image quality and a standard printing velocity. The user may perform this selecting operation on the host computer or using the operation buttons provided on the ink jet printing apparatus main body.

The ink jet printing apparatus uses one of the three printing methods based on unidirectional printing, bidirectional printing, and multipass printing. Further, even with the same printing method, the results of printing vary depending on the type of print media. Accordingly, the printing method is determined on the basis of a combination of the type of print media and the print mode. Thus, the user selects and inputs the type of print media in addition to the print mode.

The CPU determines the printing method on the basis of the print mode and the type of print media inputted by the user. The determination is made in accordance with the table described below.

FIG. 7 is a table used to determine the printing method on the basis of a combination of the print mode and the type of print media.

Thus, if ordinary paper is used as print media, when the "beautiful" mode is selected, a bidirectional 4-pass printing method is used. On the other hand, if ordinary paper is used as print media but the "fast" mode is selected, bidirectional printing is executed but one-pass printing is used in place of the multipass printing.

Here, the previously described registrations are adapted to correct a variation in the impact position caused by a difference in ejecting direction/velocity between the even nozzle and the odd nozzle as well as a variation in the impact position between a forward scan and a backward scan. However, these registrations cannot correct a variation in line density caused by the fact that the positional relationship between main droplet dots and satellite dots is reversed between a forward scan and a backward scan as described previously. Thus, in a "bidirectional and non-multipass printing" mode, in which the nonuniformity of the density attributed to satellite dots is noticeable, it is necessary to execute fine-tuning taking the impact positions of satellite dots into account.

Thus, in the present embodiment, the process routine shown below is used to fine-tune the registrations and registration values depending on the print mode.

Figure 8:
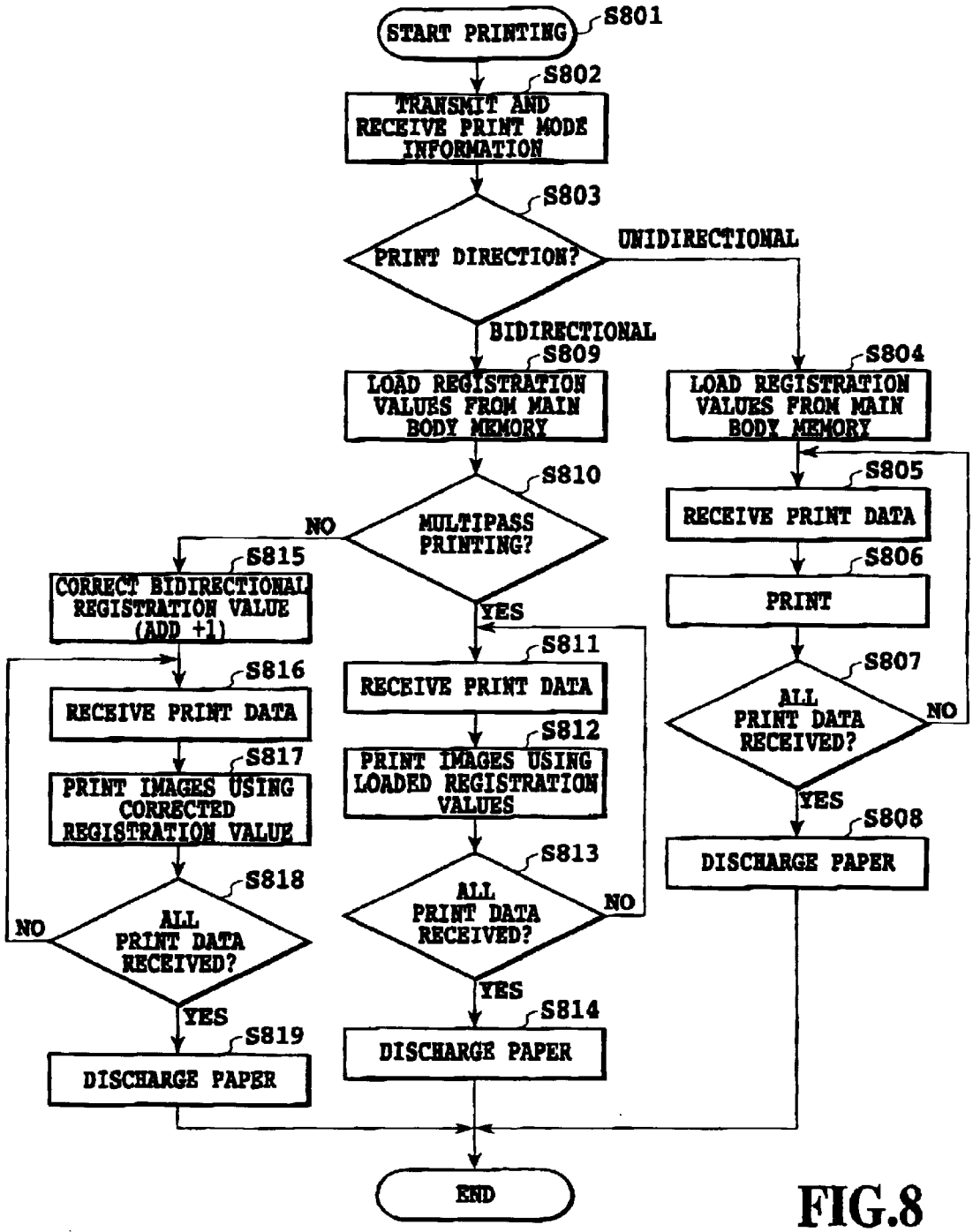
FIG. 8 is a flow chart showing a process of fine-tuning a registration adjustment value from the start till the end of a printing operation.

FIG. 8 is a flow chart showing a process of fine-tuning the registration values from the start to end of a printing operation.

The host computer inputs a print instruction to the printing apparatus (step 801). The printing apparatus receives a print mode and a type of print media inputted simultaneously with the print instruction (step 802) to determine a printing method on the basis of preset relationships. First, the apparatus determines whether this printing method is based on bidirectional or unidirectional printing (step 803). If it is based on unidirectional printing, the printing apparatus executes the process below.

(Unidirectional Printing)

In unidirectional printing, almost all satellite dots impact at one side of main droplet dots. Accordingly, it is unnecessary to fine-tune the registration value for the impact positions of satellite dots. Thus, a printing operation is performed in accordance with only the registration reference values stored in the nonvolatile memory. Specifically, the process below is executed.

First, the apparatus loads the registration reference values already stored in the nonvolatile memory in the storage device (step 804). However, since unidirectional printing is carried out, only the even and odd registration reference values and black and color row registration reference value are used and the bidirectional registration reference values are not.

The registration reference values set using the registration pattern involve the adverse effect of the satellite. However, in unidirectional printing, the positional relationship between main droplet dots and satellite dots is always the same. Accordingly, the registration reference values can be used without any corrections whether multipass printing or non-multipass printing is executed. Therefore, even with a printing method based on "unidirectional and multipass printing", a printing operation is started on the basis of the registration reference values loaded in step 804 and without fine-tuning any registration values.

The printing apparatus receives print data transmitted by the host computer (step 805). The printing apparatus then performs a printing operation (step 806). The apparatus receives and prints all the print data (step 807). The printing apparatus then discharges the results of printing (step 808) to finish this printing operation.

On the other hand, if in step 803, the printing method is determined to be based on bidirectional printing, then the process below is executed.

(Bidirectional Printing)

In bidirectional printing, the side of main droplet dots at which satellite dots impact is reversed between a forward scan and a backward scan. It is thus necessary to carry out not only adjustment based on the registration reference values but also fine-tuning with the impact positions of the satellite dots taken into consideration. However, for multipass printing, this fine-tuning operation need not be performed because the nonuniformity of the density resulting from the impact positions of the satellite dots is unnoticeable. On the other hand, for non-multipass printing, the fine-tuning operation must be performed because the nonuniformity of the density resulting from the impact positions of the satellite dots is noticeable. Thus, in the present embodiment, different processes are executed in the "bidirectional and multipass printing" mode and in the "bidirectional and non-multipass printing" mode. Specifically, these processes are executed using the following routine.

The printing apparatus loads the even and odd registration reference values, bidirectional registration reference values, and black and color row registration reference value stored in the storage device (step 809). The printing apparatus then determines whether the printing method is based on multipass printing (step S810).

Here, the bidirectional registration reference values set using the registration pattern have been recorded in the multipass mode. Accordingly, for multipass printing, the loaded registration reference values may be used as they are. The printing apparatus reads print data as in the case with the unidirectional printing (step 811). The printing apparatus then executes printing using the registration reference values (step 812). The apparatus prints all the print data (step 813). The printing apparatus then discharges the results of printing (step 814) to finish this printing operation.

On the other hand, for non-multipass printing, corrections are required because the positional relationship between the satellite dots and the main droplet dots varies In the present embodiment, it is experimentally known that in non-multipass printing, favorable results are obtained by executing a correction of "+1" on each registration reference value for multipass printing, i.e. moving the impact positions of dots formed during a backward scan, a distance equal to one pixel in the plus direction. Thus, the apparatus adds a correction value of "+1" to each registration reference value (step 816). The apparatus then receives print data (step 816), and executes printing with the corrected registration value (step 817). The apparatus prints all the print data (step 818). The apparatus then discharges the results of printing (step 819) to finish this printing operation.

The correction value varies depending on the dot size ratio or density ratio of a main droplet dot to a satellite dot, or the length of misalignment L between a main droplet dot and a satellite dot.

As described above, a printing operation can be achieved without the degradation of images caused by satellite dots, by using different bidirectional registration values for multipass printing and for non-multipass printing.

In the present embodiment, the bidirectional registration patches of the registration pattern are subjected to multipass printing for registration. For multipass printing, the registration values are used as they are, whereas for non-multipass printing, they are corrected. However, the method described below is also possible. The bidirectional registration patches of the registration pattern are subjected to non-multipass printing. For multipass printing, the registration values are corrected, whereas for non-multipass printing, they are used as they are.

Further, the registration values may be corrected for printing whether multipass printing or non-multipass printing is carried out with values adjusted using a registration pattern printed by a certain printing method. In this case, different correction values are used for multipass printing and for non-multipass printing.

Furthermore, the adjustment patches of a registration pattern may be printed by both the multipass and non-multipass printing methods so that both resulting patches can be corrected.

In the description of the present embodiment, the registration pattern is printed so that the user can register the pattern. However, the same effects can be produced by utilizing known automatic registration means.

Further, the length of misalignment L between a main droplet dot and a satellite dot is proportional to the scanning velocity of the print head. Accordingly, with a printing apparatus having a plurality of scanning velocities, a correction value is desirably set for each of the scanning velocities.

EXAMPLE 2

In Example 1, description has been given of registration value fine-tuning adapted to prevent the nonuniformity of the density caused by the misaligned impact positions of satellite dots associated with the characteristics of a particular printing method. However, images may be degraded not only by satellite dots but also by a small variation in the impact position of each dot between a forward scan and a backward scan. This is because the registration values set in accordance with the drive mode for a predetermined print head do not match another drive mode. Thus, in the present example, description will be given of a printing operation of fine-tuning the registration values in accordance with the drive mode for the print head.

The whole configuration, the head configuration, the electrical configuration, and the registration adjustment are similar to those in Example 1, described previously. Thus, their detailed description is omitted.

(Printing Operation)

The ink jet printing apparatus according to the present embodiment is provided with the three print modes in order to achieve the respective grades of print images as desired by users. The user can select the "beautiful" mode if he or she desires a high-quality image in spite of a long time required for printing. The user can select the "fast" mode if he or she desires a reduction in the time required for printing in spite of the slight degradation of images. The user can select the "standard" mode if he or she desires a standard image quality and a standard printing velocity. The user may perform this selecting operation on the host computer or by using the operation buttons provided on the ink jet printing apparatus main body.

The ink jet printing apparatus uses one of the four printing methods based on three-, four-, six-, and eight-pass printing. Here, the four-, six, and eight-pass printing methods use the 1200-dpi drive mode. The three-pass printing method uses the 600-dpi drive mode because it executes a larger number of ejections per scan than the other methods.

Further, even with the same printing method, the results of printing vary depending on the type of print media. Accordingly, the printing method is determined on the basis of a combination of the type of print media and the print mode. Thus, the user selects and inputs the type of print media in addition to the print mode.

The CPU determines the printing method on the basis of the print mode and the type of print media inputted by the user. The determination is made in accordance with Table 2.

TABLE 2

| | Print media | | |
|---|---|---|---|
| Print grade | Ordinary paper | Coated paper | Glossy paper |
| Beautiful | Bidirectional printing Multipass printing (six passes) 1.200-dpi driving | Bidirectional printing Multipass printing (eight passes) 1.200-dpi driving | Bidirectional printing Multipass printing (eight passes) 1,200-dpi driving |
| Standard | Bidirectional printing Multipass printing (four passes) 1,200-dpi driving | Bidirectional printing Multipass printing (six passes) 1,200-dpi driving | Bidirectional printing Multipass printing (six passes) 1,200-dpi driving |
| Fast | Bidirectional printing Multipass printing (three passes) 600-dpi driving | Bidirectional printing Multipass printing (three passes) 600-dpi driving | Bidirectional printing Multipass printing (four passes) 1,200-dpi driving |

Figure 9:
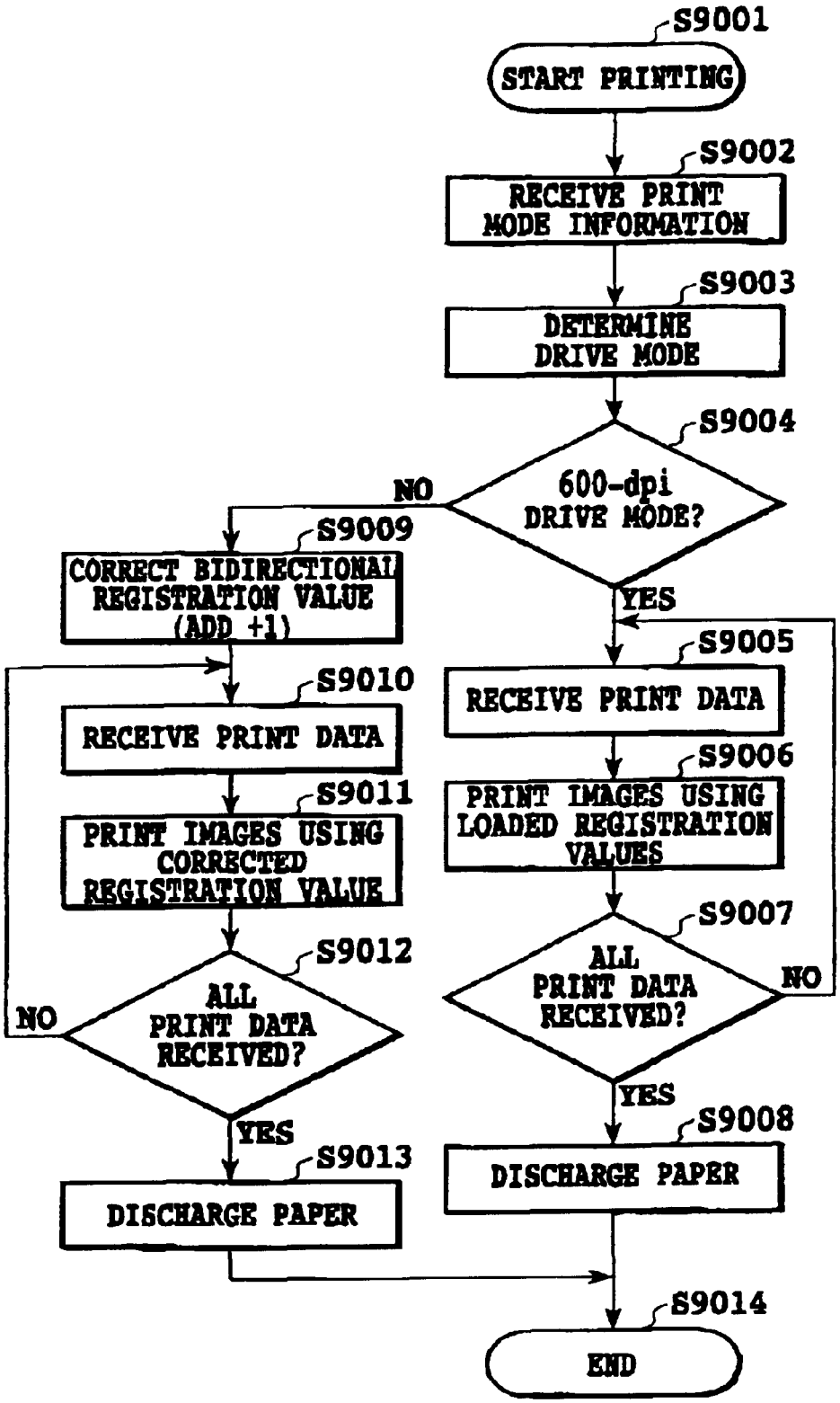
FIG. 9 is a flow chart showing a process of fine-tuning a registration adjustment value from the start till the end of a printing operation according to Example 1.
Figures 10A, 10B, 10C:
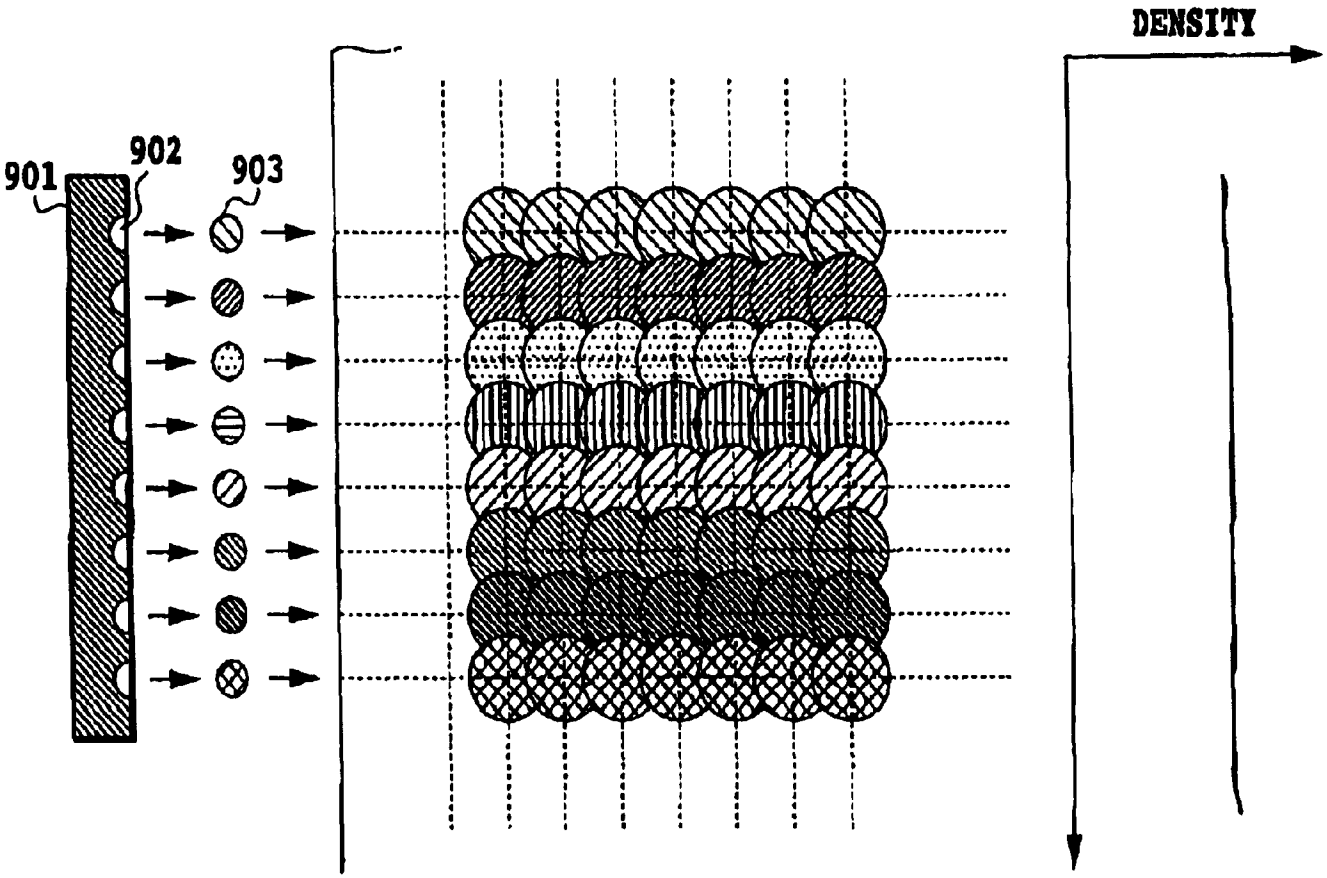
FIG. 10A is a view showing ink droplets of an ideal size ejected from a print head in an ideal direction.
FIG. 10B is a view showing dots obtained if the ink droplets impact at ideal impact positions.
FIG. 10C is a view showing a print density observed under the print conditions in FIG. 10B.
Figures 11A, 11B, 11C:
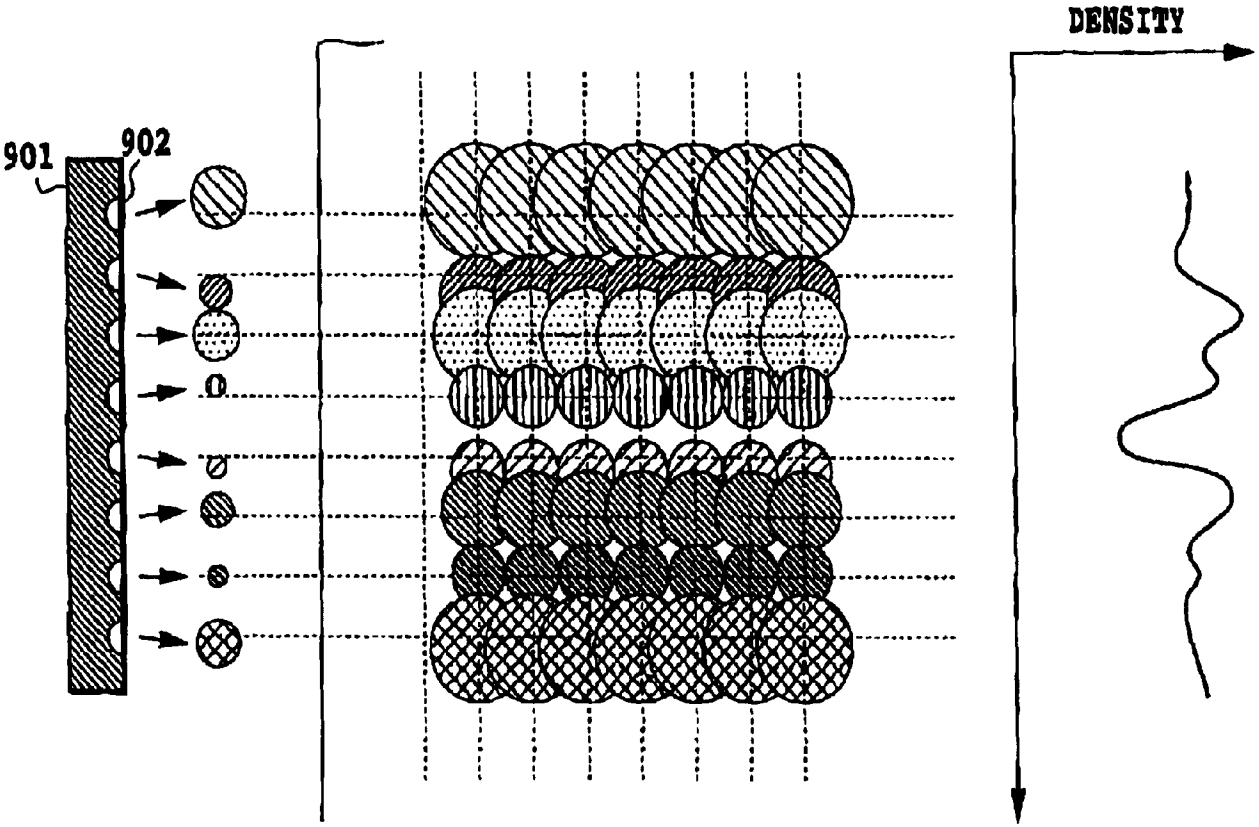
FIG. 11A is a view showing an example of ink droplets ejected from the print head during actual printing.
FIG. 11B is a view showing dots obtained if the ink droplets in FIG. 11A impact a print medium.
FIG. 11C is a view showing a print density observed under the print conditions in FIG. 11B.
Figures 12A, 12B, 12C:
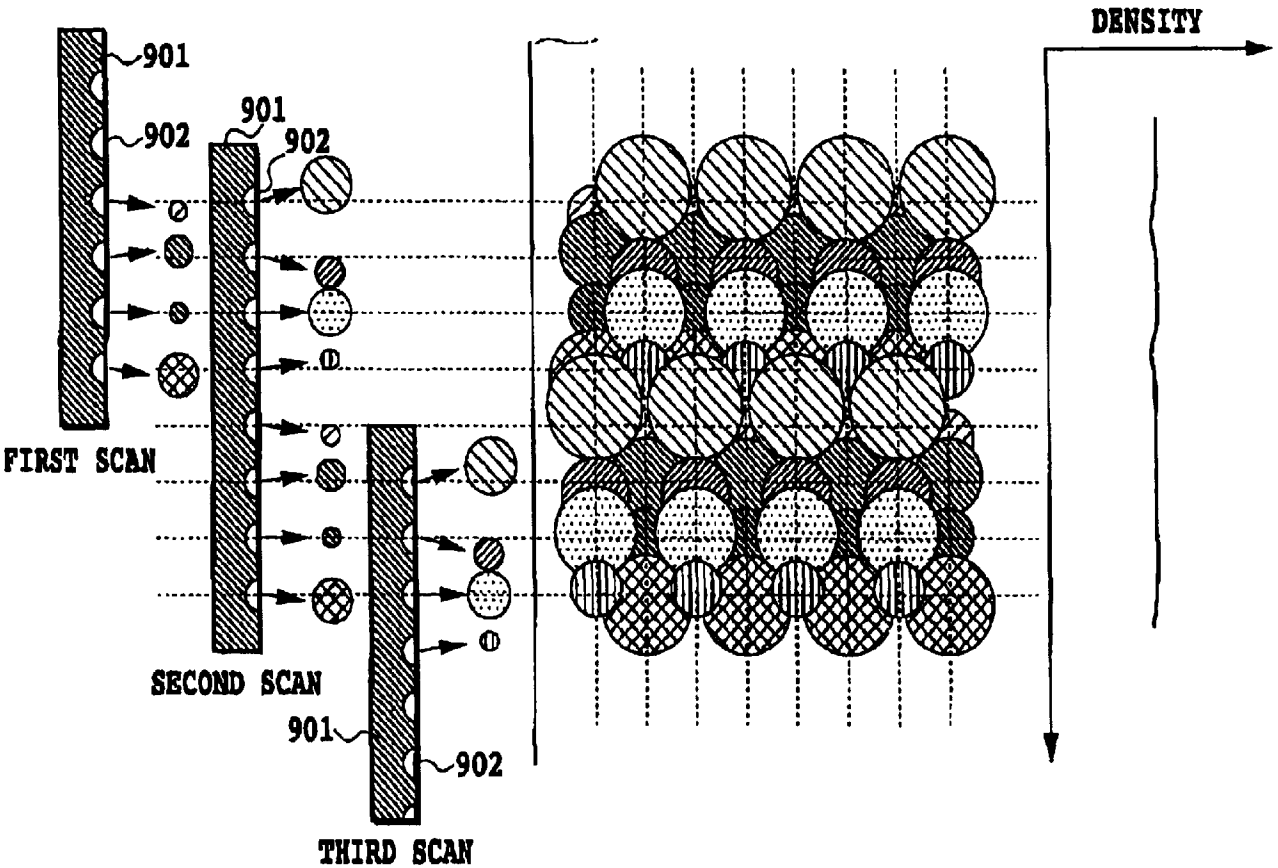
FIG. 12A is a view showing an example of ink droplets ejected from the print head during multipass printing.
FIG. 12B is a view showing dots obtained if the ink droplets in FIG. 12A impact a print medium.
FIG. 12C is a view showing a print density observed under the print conditions in FIG. 12B.
Figure 13A:
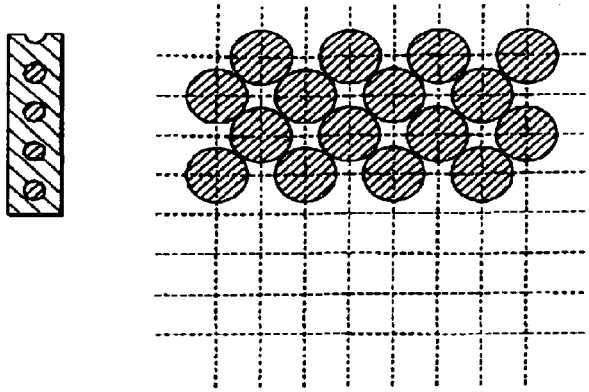
FIG. 13A is a schematic view showing a first pattern of multipass printing.
Figure 13B:
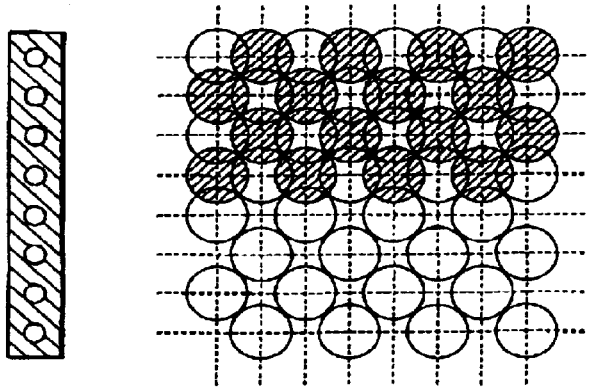
FIG. 13B is a schematic view showing a reverse pattern of multipass printing.
Figure 13C:
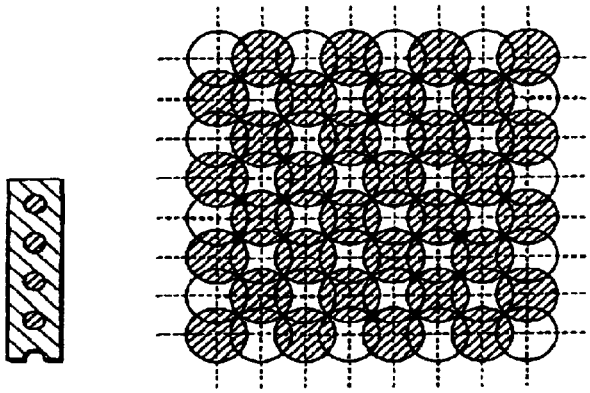
FIG. 13C is a schematic view showing a combination with the first pattern and the second pattern of multipass printing.
Figure 14A:
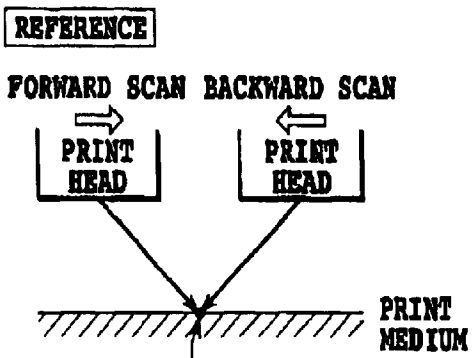
FIG. 14A is a view showing an ideal impact state in connection with the relationship between the scan of the print head and the impact position.
Figure 14B:
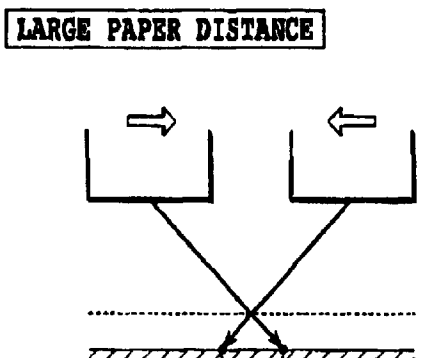
FIG. 14B is a view showing an impact state observed if there is a large paper distance between the print head and a print medium.
Figure 14C:
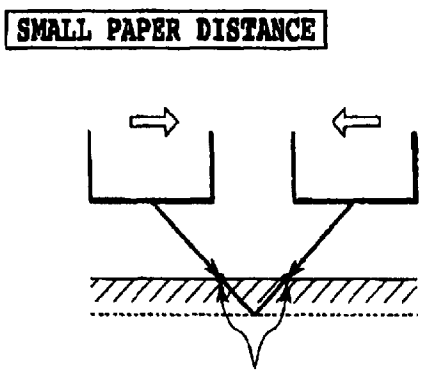
FIG. 14C is a view showing an impact state observed if the paper distance is small.
Figure 14D:
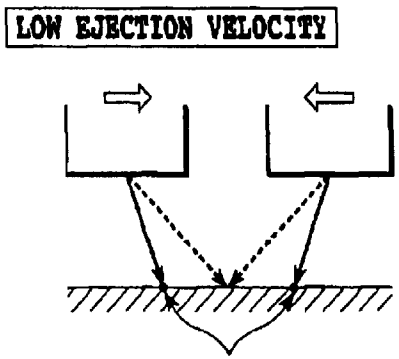
FIG. 14D is a view showing an impact state observed if an ejection velocity is high.
Figure 14E:
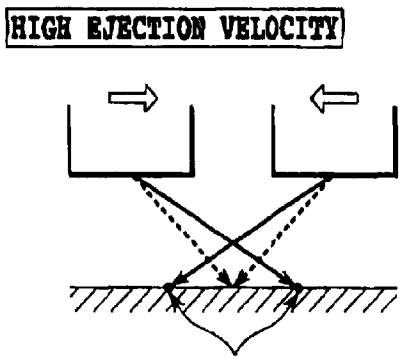
FIG. 14E is a view showing an impact state observed if the ejection velocity is low.
Figure 15:
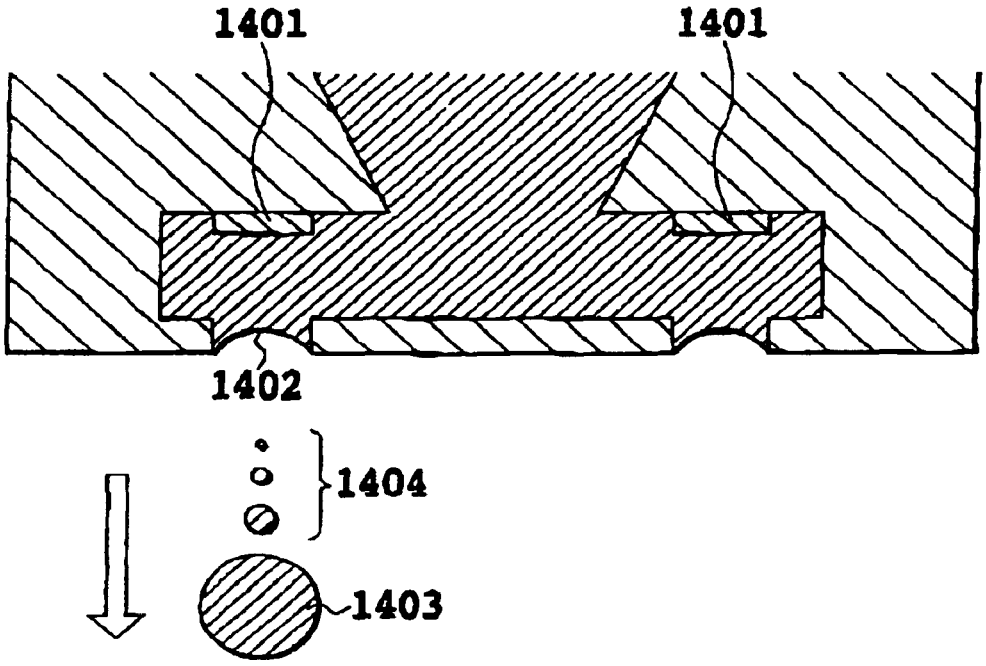
FIG. 15 is a schematic sectional view showing the vicinity of a nozzle in the print head.
Figure 16:
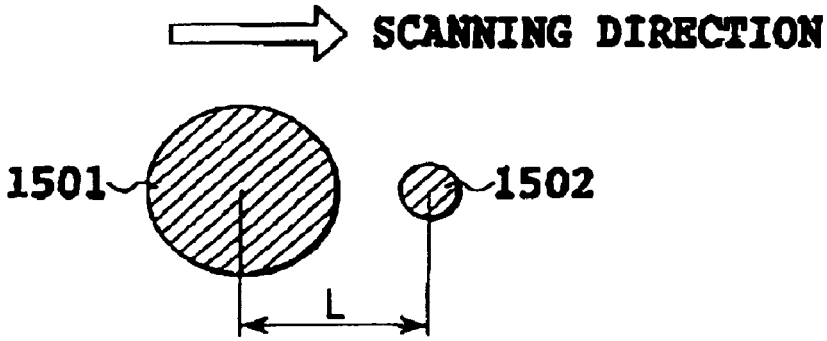
FIG. 16 is a view showing a main droplet and a satellite droplet.
Figure 17A:
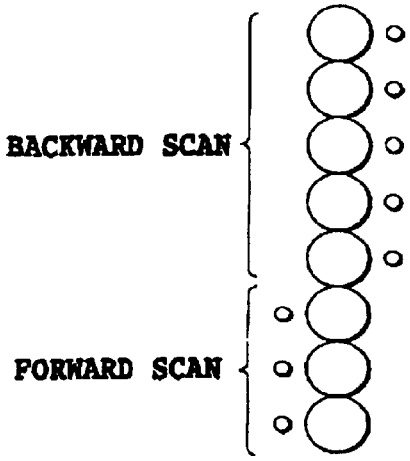
FIG. 17A is a view showing the positional relationship between main droplets and satellite droplets in the case of bidirectional and non-multipass printing.
Figure 17C:
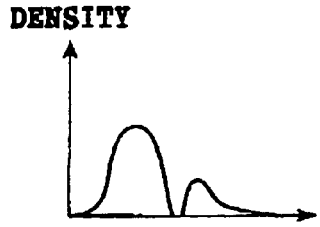
FIG. 17C is a chart showing a variation in line density in FIG. 17B.
Figure 17D:
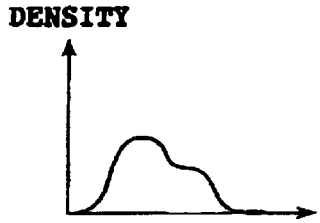
FIG. 17D is a chart showing a substantial variation in line density.
Figure 17B:
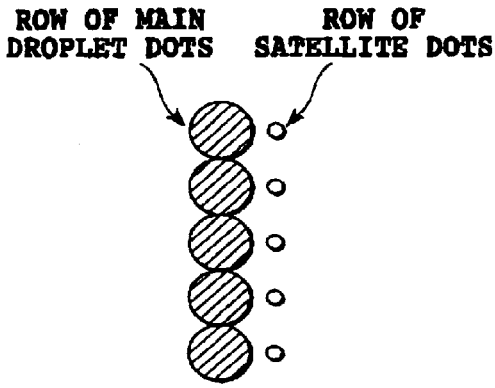
FIG. 17B is an enlarged view of a backward scan portion in FIG. 17A.
Figure 17E:
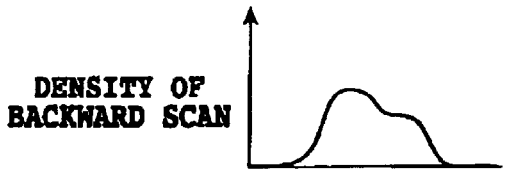
FIG. 17E is a chart showing the line density observed during forward and backward scans.
Figure 17F:
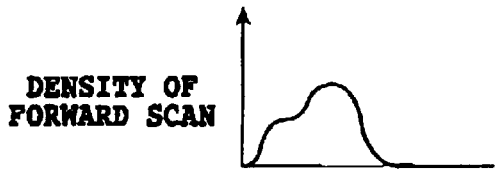
FIG. 17F is a chart showing the line density observed during a forward scan.
Figure 18A:
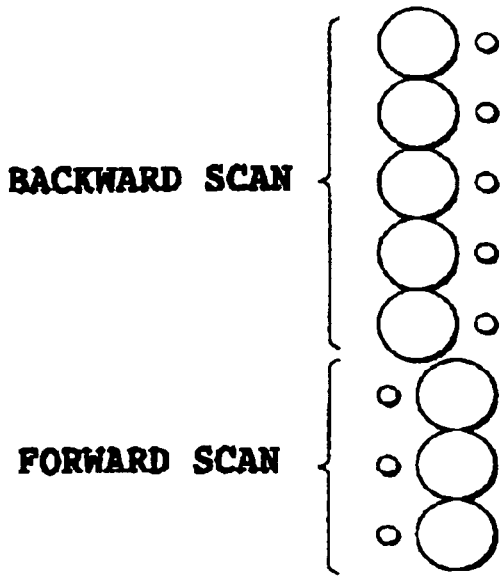
FIG. 18A is a view showing the positional relationship between main droplets and satellite droplets in the case of registered bidirectional and non-multipass printing.
Figure 18B:
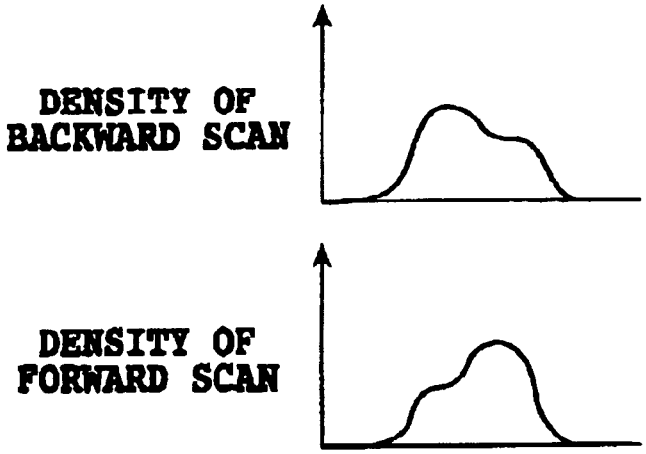
FIG. 18B is a chart showing the line density observed during forward and backward scans.
Figure 19A:
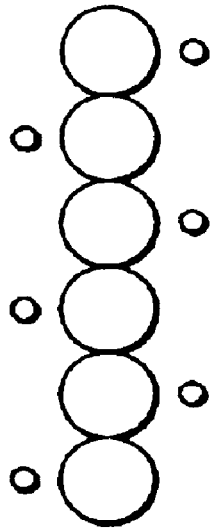
FIG. 19A is a view showing the positional relationship between main droplets and satellite droplets in the case of multipass printing.
Figure 19B:
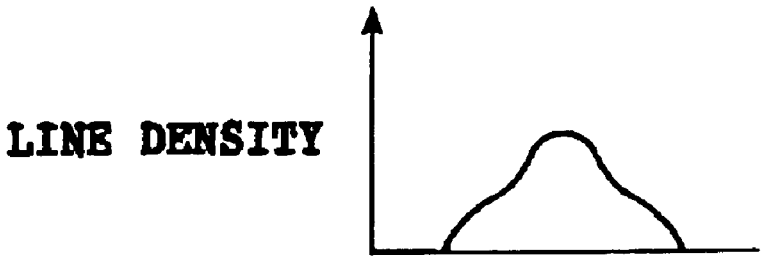
FIG. 19B is a chart showing the line density observed in FIG. 19A.
Figure 20:
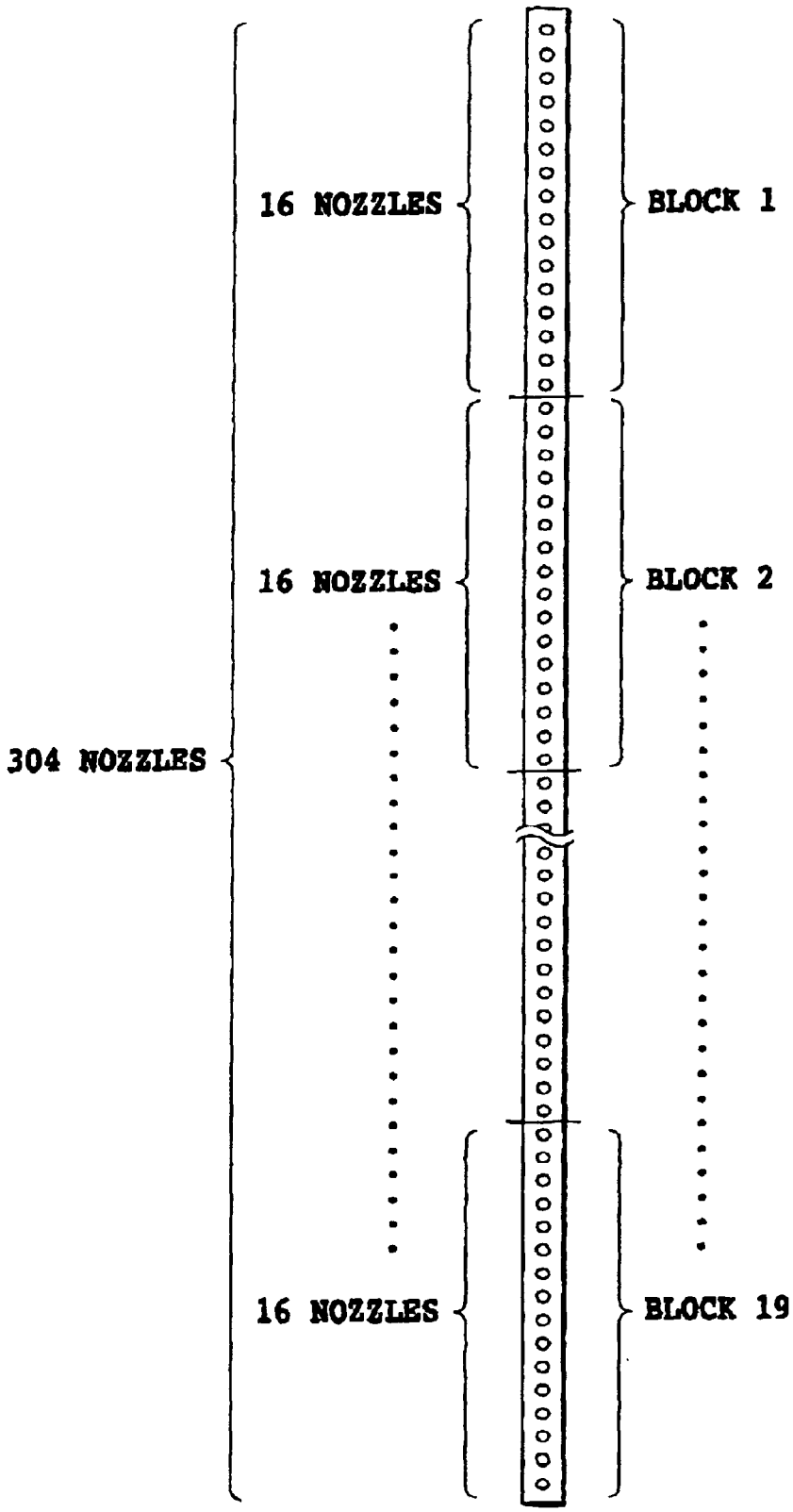
FIG. 20 is a schematic view showing a block configuration of nozzle rows.
Figure 21:
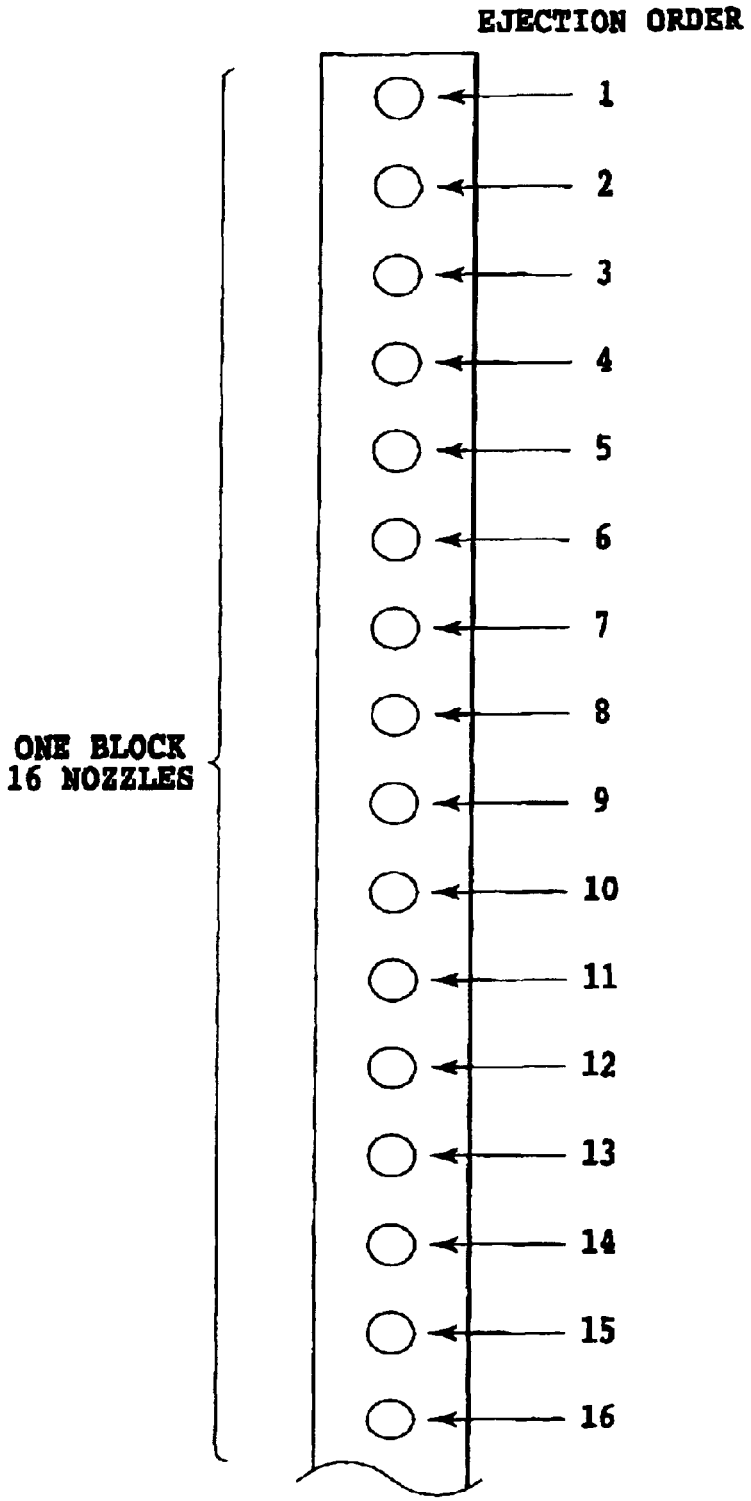
FIG. 21 is a schematic view showing the ejection order of the nozzles within one block.
Figure 22:
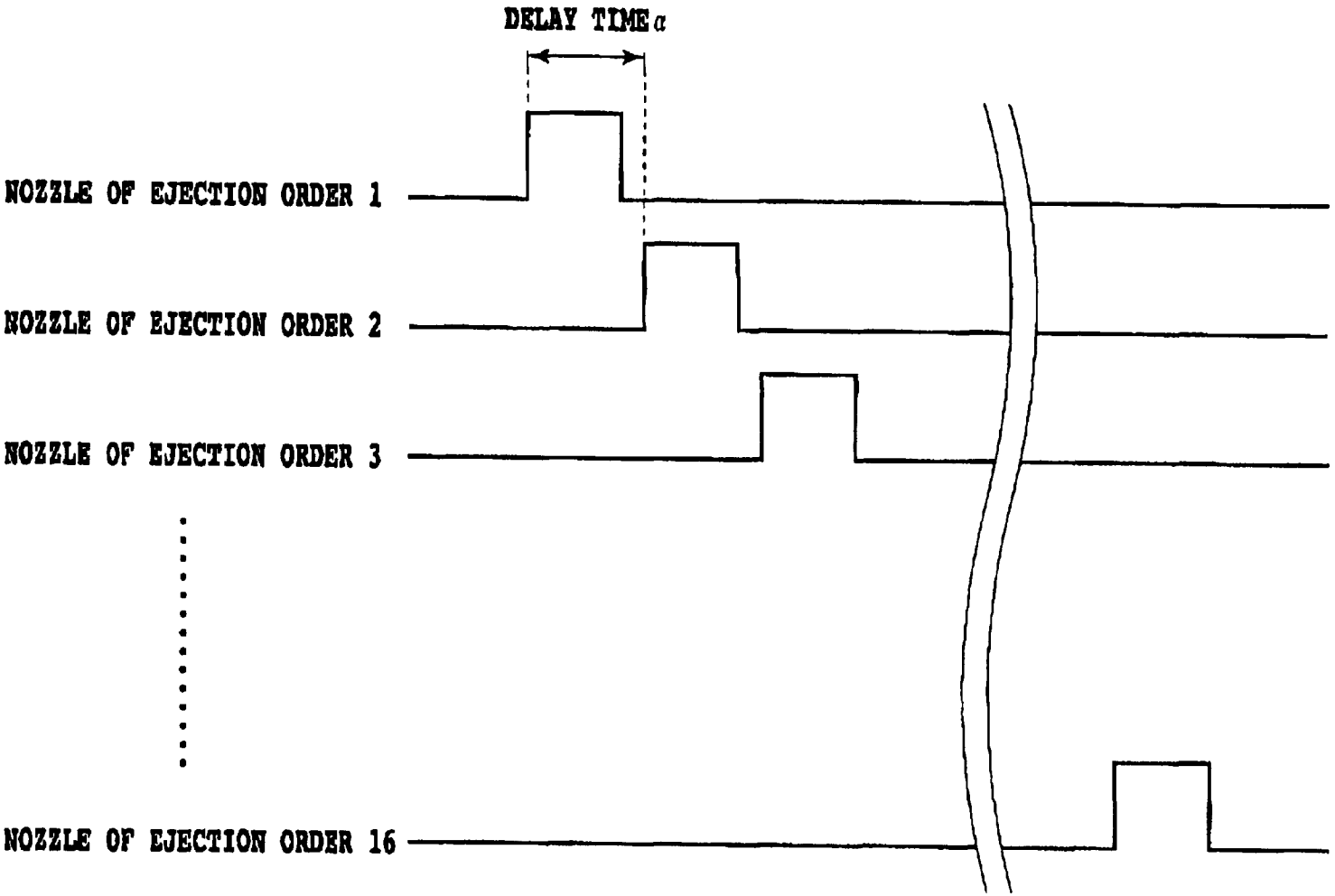
FIG. 22 is a time chart showing ejection timings.
Figure 23:
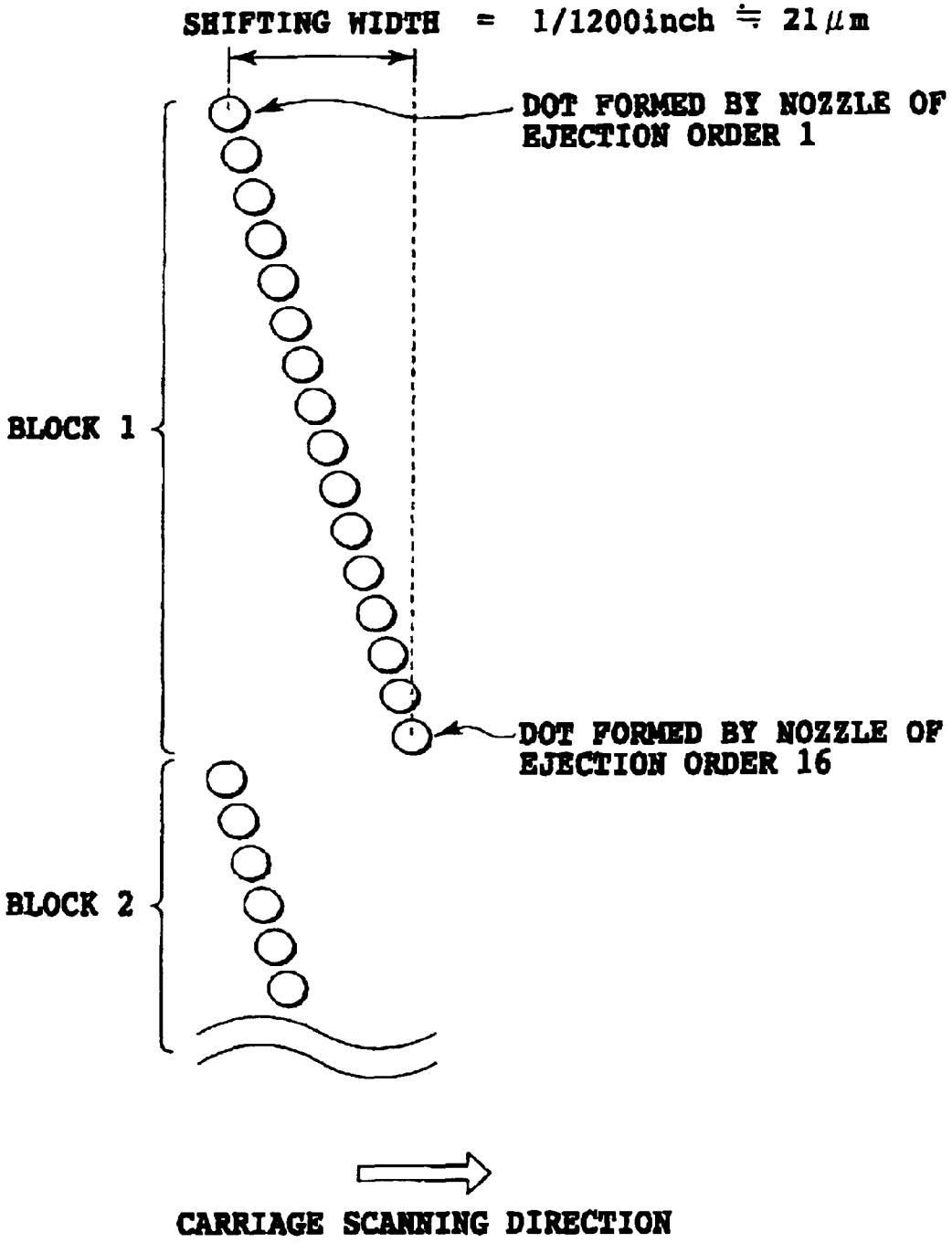
FIG. 23 is a schematic view showing impact positions in each block.
Figure 24B:
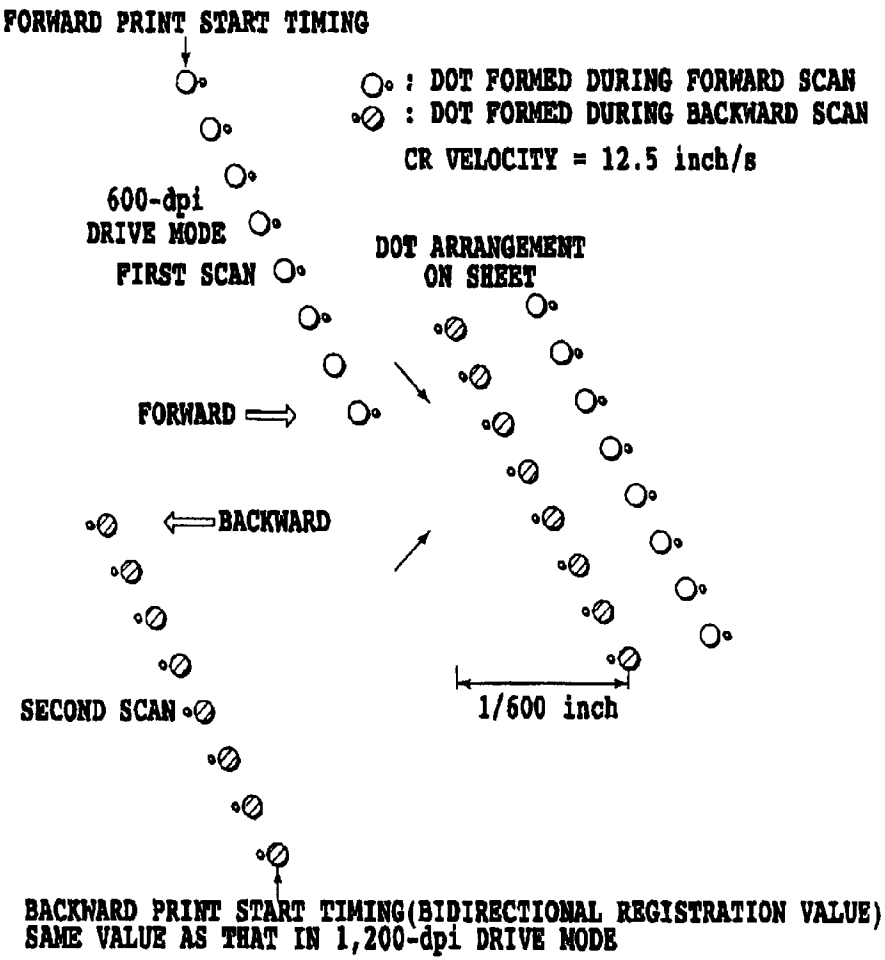
FIG. 24B is a schematic view showing the results of printing in a 600-dpi drive mode.
Figure 24A:
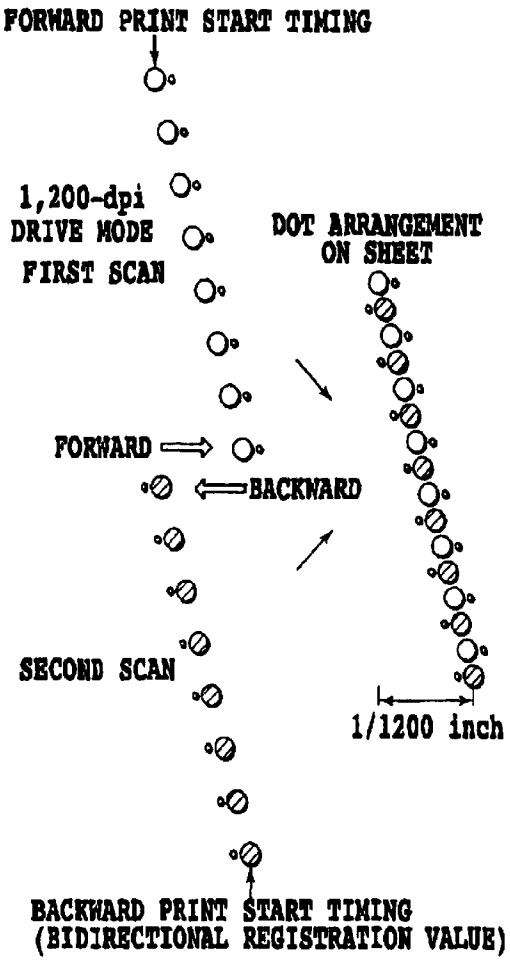
FIG. 24A is a schematic view showing the results of printing in a 1,200-dpi drive mode.

FIG. 9 is a flow chart showing a process of fine-tuning the registration values from the start to end of a printing operation.

The host computer inputs a print instruction to the printing apparatus (step 9001). The printing apparatus receives a print mode and a type of print media inputted simultaneously with the print instruction to determine a printing method including the number of passes and the drive mode, on the basis of preset relationships (step 9002). The printing apparatus determines whether the print mode is based on the 600-dpi drive mode or the 1,200-dpi drive mode (step 9003). If it is based on the 600-dpi drive mode, the printing apparatus executes the following process (step 9004).

The printing apparatus loads the even and odd registration reference values, bidirectional registration reference values, and black and color row registration reference value stored in the storage device (step 9005). Here, the bidirectional registration reference values set using the registration pattern have been recorded in the 600-dpi drive mode. Accordingly, if the 600-dpi drive mode is used for printing, the loaded registration reference values may be used as they are.

The printing apparatus sequentially reads print data and then executes printing using the registration reference values (step 9006).

Upon printing all the print data (step 9007), the apparatus discharges the results of printing to finish this printing operation (step 9008, step 9014).

On the other hand, the 1,200-dpi drive mode requires corrections because of its different dot shifting width. In this implementation, the difference in dot shifting width between the 600-dpi drive mode and the 1,200-dpi drive mode is "+1" at 1,200 dpi. Accordingly, favorable results are obtained by executing a correction of "+1" on each registration reference value for multipass printing, i.e. moving the impact positions of dots formed during a backward scan, a distance equal to one pixel in the plus direction. Thus, the printing apparatus adds a correction value of "+1" to each registration reference value (step 9009). The printing apparatus then receives print data (step 9010) and executes printing with the corrected registration value (step 9011). The apparatus prints all the print data (step 9012). The printing apparatus then discharges the results of printing to finish this printing operation.

As described above, when a printing operation is performed by using different bidirectional registration values in the respective drive modes, a variation in the impact position dependent on the drive mode can be corrected to print images without degradation.

In the present example, if the registration pattern is printed in the 600-dpi drive mode and the print data are printed in the 600-dpi drive mode, the registration values are used as they are. In contrast, if the registration pattern is printed in the 600-dpi drive mode and the print data are printed in the 1,200-dpi drive mode, the registration values are corrected. However, reversely, the method described below is also possible. If the registration pattern is printed in the 1,200-dpi drive mode and the print data are printed in the 1,200-dpi drive mode, the registration values are used as they are. In contrast, if the registration pattern is printed in the 1,200-dpi drive mode and the print data are printed in the 600-dpi drive mode, the registration values are corrected.

In Example 2, multipass printing is carried out in all the print modes. However, the present invention is not limited to this aspect. It is possible to use a mixture of multipass printing and non-multipass printing. It is also possible to use a combination with the registration fine-tuning in Example 1.

As described above, the drive timing adjustment value determining step uses different adjustment values for a case in which the movement pitch during the paper feeding operation is smaller than the arrangement pitch of the nozzles in the print head and for other cases. Consequently, in the bidirectional printing, an image is printed at an appropriate position whether or not the movement pitch during the paper feeding operation is smaller than the arrangement pitch of the nozzles in the print head. Therefore, in an ink jet printing apparatus having a plurality of print modes including the bidirectional print mode, multipass print mode, and non-multipass print mode, images can be appropriately printed without degradation in all the modes.

Further, even if the diameter of ejected ink droplets decreases to make satellite droplets relatively noticeable, images can always be corrected in accordance with the impact positions of the satellite droplets. This makes it possible to suppress the degradation of images caused by the satellite droplets.

Furthermore, even with a plurality of drive modes for the print head, images can always be corrected so as to align the impact positions of dots during a backward scan with the impact positions of dots during a forward scan, in accordance with a selected drive mode.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A print position adjusting method of using a print head having a plurality of arranged nozzles from which ink is ejected to a print medium, to perform alternately a printing operation of scanning the print head in a predetermined direction different from a direction in which the plurality of nozzles are arranged, to eject ink from the nozzles to a print medium during the scan, and a paper feeding operation of effecting relative movement of the print medium and the print head a distance corresponding to a predetermined movement pitch in a direction different from the predetermined direction of scanning of the print head, the print head being scanned over the print medium by reciprocating in the predetermined direction, to enable bidirectional printing in which the printing operation is performed during both a forward scan and a backward scan, said method comprising:

a mode providing step of providing a plurality of print modes having different dot arrangements for a scan of the print head;

a mode selecting step of selecting one of the plurality of print modes;

a determining step of determining an adjustment value that varies a drive timing for the plurality of nozzles between the forward scan and the backward scan in accordance with the print mode selected in said mode selecting step; and a printing step of performing the printing operation using the drive timing for the nozzles determined on the basis of the adjustment value determined in said determining step.

2. A print position adjusting method as claimed in claim 1, wherein the plurality of print modes include a multipass print mode in which a printing operation is performed both during the forward scan of the print head and during the backward scan of the print head and in which the movement pitch during the paper feeding operation is smaller than an arrangement pitch of the nozzles in the print head, and said determining step uses different adjustment values in the multipass print mode and in the other print modes.

3. A print position adjusting method as claimed in claim 1, wherein impact positions of dots formed by ink droplets ejected from the nozzles driven using a drive timing based on the adjustment value differ from impact positions of dots formed by ink droplets ejected from the nozzles driven using a drive timing not based on the adjustment value.

4. A print position adjusting method as claimed in claim 2, wherein in said determining step, in the print modes other than the multipass print mode, the adjustment value comprises an adjustment value determined in the multipass print mode plus a predetermined correction value.

5. A print position adjusting method as claimed in claim 1, wherein said determining step selects an optimum one of a plurality of print patterns obtained by ejecting ink using different nozzle drive timings and sets the adjustment value to be a drive timing with which the selected print pattern is printed.

6. A print position adjusting method as claimed in claim 5, wherein the plurality of print patterns are obtained by varying time required after ink has been ejected from an even-numbered nozzle in a nozzle arrangement direction and before ink is ejected from a corresponding odd-numbered nozzle in the nozzle arrangement direction and varying ejection timings during the forward and backward scans.

7. A print position adjusting method as claimed in claim 1, wherein the plurality of print modes include a plurality of drive modes having different time intervals at which ink is ejected from the nozzles to the print medium, and said determining step uses as the adjustment value an adjustment reference value determined for a first drive mode, and if any of the drive modes other than the first drive mode is selected, uses as the adjustment value the adjustment reference value plus a predetermined correction value.

8. An ink jet printing apparatus that uses a print head having a plurality of arranged nozzles from which ink is ejected to a print medium, to perform alternately a printing operation of scanning the print head in a predetermined direction different from a direction in which the plurality of nozzles are arranged, to eject ink from the nozzles to the print medium during the scan, and a paper feeding operation of effecting relative movement of the print medium and the print head a distance corresponding to a predetermined movement pitch in a direction different from the predetermined direction of scanning of the print head, the print head being scanned over the print medium by reciprocating in the predetermined direction, to enable bidirectional printing in which the printing operation is performed during both a forward scan and a backward scan, said apparatus comprising:

means providing a plurality of print modes having different dot arrangements for a scan of the print head;

mode selecting means for selecting one of the plurality of print modes;

determining means for determining an adjustment value that varies a drive timing for the plurality of nozzles between the forward scan and the backward scan in accordance with the print mode selected by said mode selecting means; and printing means for performing the printing operation using the drive timing for the nozzles determined on the basis of the adjustment value determined by said determining means.

9. An ink jet printing apparatus as claimed in claim 8, wherein the plurality of print modes include a multipass print mode in which a printing operation is performed both during the forward scan of the print head and during the backward scan of the print head and in which the movement pitch during the paper feeding operation is smaller than an arrangement pitch of the nozzles in the print head, and said determining means uses different adjustment values in the multipass print mode and in the other print modes.

10. An ink jet printing apparatus as claimed in claim 9, further comprising creating means for creating a plurality of adjustment patterns by driving the nozzles while varying a drive timing for the nozzles, and wherein said determining means selects one of the adjustment patterns created by said creating means and determines a reference value for the adjustment value on the basis of a drive timing with which the selected pattern is created so that in the multipass print mode, the reference value is used as the adjustment value, whereas in the print modes other than the multipass print mode, the reference value plus a predetermined correction value is used as the adjustment value.

11. An inkjet printing apparatus as claimed in claim 10, wherein the print modes further include a unidirectional print mode in which a printing operation is performed only during the forward scan and a bidirectional print mode in which a printing operation is performed both during the forward scan of the print head and during the backward scan of the print head, and said determining means determines that the adjustment value for the bidirectional print mode is the reference value plus a predetermined correction value, and the adjustment value for the unidirectional print mode is the reference value.

12. An ink jet printing apparatus as claimed in claim 8, wherein each of the nozzles ejects a main droplet that is an ink droplet forming a main dot and a satellite droplet that forms a satellite dot near the main dot, the satellite dot having a smaller dot diameter than the main dot, and an impact position of the satellite droplet varying between the forward scan and backward scan of the print head, and said determining means determines the adjustment value so that in connection with a high-density portion formed on the print medium by the printing means and composed of the main dots and the satellite dots, the high-density portion formed during the forward scan is adjacent to the high-density portion formed during the backward scan, in a scan direction of the print head.

13. An ink jet printing apparatus as claimed in claim 8, wherein the print head uses thermal energy to generate bubbles in ink so that pressure generated by the bubbles causes the ink to be ejected as droplets.

14. An ink jet printing apparatus as claimed in claim 8, wherein the plurality of print modes include a plurality of drive modes having different time intervals at which ink is ejected from the nozzles to the print medium, and said determining means uses as the adjustment value an adjustment reference value determined for a first drive mode, and if any of the drive modes other than the first drive mode is selected, uses as the adjustment value the adjustment reference value plus a predetermined correction value.

15. An ink jet printing system comprised of a print position adjusting apparatus that uses a print head having a plurality of arranged nozzles from which ink is ejected to a print medium, to perform alternately a printing operation of scanning the print head in a predetermined direction different from a direction in which the plurality of nozzles are arranged, to eject ink from the nozzles to the print medium during the scan, and a paper feeding operation of relatively moving the print medium and the print head a distance corresponding to a predetermined movement pitch in a direction different from the predetermined direction of scanning of the print head, the print head being scanned over the print medium by reciprocating in the predetermined direction, to enable bidirectional printing in which the printing operation is performed during both a forward scan and a backward scan; and a host computer connected to the ink jet printing apparatus, said system comprising:

means providing a plurality of printing modes having different dot arrangements for a scan of the print head;

mode selecting means for selecting one of the plurality of print modes;

determining means for determining an adjustment value that varies a drive timing for the plurality of nozzles between the forward scan and the backward scan in accordance with the print mode selected by said mode selecting means; and printing means for driving the nozzles in accordance with the drive timing for the nozzles determined on the basis of the adjustment value determined by the determining means.

16. An ink jet printing system as claimed in claim 15, wherein the plurality of print modes include a multipass print mode in which a printing operation is performed both during the forward scan of the print head and during the backward scan of the print head and in which the movement pitch during the paper feeding operation is smaller than an arrangement pitch of the nozzles in the print head, said system further comprises creating means for creating a plurality of adjustment patterns by driving the nozzles while varying a drive timing for the nozzles, said host computer comprises adjustment pattern selecting means for transmitting one of the adjustment patterns, which is selected by the user, to said ink jet printing apparatus, and said determining means selects one of the adjustment patterns created by said creating means and determines a reference value for the adjustment value on the basis of a drive timing with which the selected pattern is created so that during the paper feeding operation, in the multipass print mode, the reference value is used as the adjustment value, whereas in the print modes other than the multipass print mode, the reference value plus a predetermined correction value is used as the adjustment value.

* * * * *

UNITED STATES PATENT AND TRADEMARK OFFICE

CERTIFICATE OF CORRECTION

PATENT NO. : 6,997,541 B2
APPLICATION NO. : 10/649956
DATED : February 14, 2006
INVENTOR(S) : Tetsuya Edamura et al.

It is certified that error appears in the above-identified patent and that said Letters Patent is hereby corrected as shown below:

COLUMN 9:
Line 26, “plurality” should read --plurality of--.
Line 46, “Ink” should read --ink--.

COLUMN 11:
Line 67, “Ink” should read --ink--.

COLUMN 13:
Line 54, “Input” should read --input--.

COLUMN 14:
Line 64, “Is” should read --is--.

COLUMN 17:
Line 67, “varies” should read --varies.--.

COLUMN 24:
Line 29, “by the” should read --by said--.

Signed and Sealed this

Twenty-sixth Day of June, 2007

JON W. DUDAS
*Director of the United States Patent and Trademark Office*

UNITED STATES PATENT AND TRADEMARK OFFICE

CERTIFICATE OF CORRECTION

PATENT NO. : 6,997,541 B2
APPLICATION NO. : 10/649956
DATED : February 14, 2006
INVENTOR(S) : Tetsuya Edamura et al.

It is certified that error appears in the above-identified patent and that said Letters Patent is hereby corrected as shown below:

COLUMN 9:
Line 26, "plurality" should read --plurality of--.
Line 46, "Ink" should read --ink--.

COLUMN 11:
Line 67, "Ink" should read --ink--.

COLUMN 13:
Line 54, "Input" should read --input--.

COLUMN 14:
Line 64, "Is" should read --is--.

COLUMN 17:
Line 67, "varies" should read --varies.--.

COLUMN 24:
Line 29, "by the" should read --by said--.

Signed and Sealed this

Tenth Day of July, 2007

JON W. DUDAS
*Director of the United States Patent and Trademark Office*